US009441839B2

(12) United States Patent
Deng

(10) Patent No.: US 9,441,839 B2
(45) Date of Patent: Sep. 13, 2016

(54) HEATING APPARATUS WITH FAN

(76) Inventor: David Deng, Diamond Bar, CA (US)

( * ) Notice: Subject to any disclaimer, the term of this patent is extended or adjusted under 35 U.S.C. 154(b) by 1217 days.

(21) Appl. No.: 13/193,454

(22) Filed: Jul. 28, 2011

(65) Prior Publication Data

US 2012/0031392 A1 Feb. 9, 2012

Related U.S. Application Data

(60) Provisional application No. 61/368,637, filed on Jul. 28, 2010, provisional application No. 61/408,549, filed on Oct. 29, 2010.

(51) Int. Cl.

| | |
|---|---|
| ***F24B 1/198*** | (2006.01) |
| ***F24B 1/188*** | (2006.01) |
| ***F24B 1/192*** | (2006.01) |
| ***F24B 1/18*** | (2006.01) |
| ***F23L 13/06*** | (2006.01) |
| ***F23L 13/02*** | (2006.01) |
| ***F24H 3/10*** | (2006.01) |
| ***F23B 80/04*** | (2006.01) |
| ***F23C 7/06*** | (2006.01) |
| ***F23D 14/60*** | (2006.01) |
| ***F23D 14/64*** | (2006.01) |
| *F24H 9/00* | (2006.01) |
| *F24H 9/20* | (2006.01) |

(52) U.S. Cl.

CPC ..... *F24B 1/1808* (2013.01); *F23B 80/04* (2013.01); *F23C 7/06* (2013.01); *F23D 14/60* (2013.01); *F23D 14/64* (2013.01); *F23L 13/02* (2013.01); *F23L 13/06* (2013.01); *F24H 3/105* (2013.01); *F23D 2203/102* (2013.01); *F23J 2211/101* (2013.01); *F23J 2213/203* (2013.01); *F23N 2035/06* (2013.01); *F24D 2200/10* (2013.01); *F24H 9/0063* (2013.01); *F24H 9/2085* (2013.01)

(58) Field of Classification Search

CPC ..... F24B 1/1808; F23L 13/02; F23L 13/06; F23B 8/04; F23C 7/06; F23D 14/60; F23D 14/66

USPC ..... 126/512, 516, 521, 529, 531, 533, 547

See application file for complete search history.

(56) References Cited

U.S. PATENT DOCUMENTS 1,051,072 A 1/1913 Bradley
1,867,110 A 7/1932 Signore (Continued)

FOREIGN PATENT DOCUMENTS

JP 2003 074838 A 3/2003

OTHER PUBLICATIONS

Heat and Glo, Escape-42DV Owner's Manual, Rev. i, Dec. 2006.

(Continued)

*Primary Examiner* — William G Corboy

(74) *Attorney, Agent, or Firm* — Knobbe Martens Olson & Bear LLP

(57) ABSTRACT

A heating apparatus can have a sealed combustion chamber, a burner, and various air channels to direct air into the sealed combustion chamber and to provide heated air to the desired area or environment such as an interior room. A channel can direct a flow of air along a face of the sealed combustion chamber to cool the face. The channel can be within or outside of the sealed combustion chamber. Alternatively, or in addition, the heating apparatus can be capable of operating as a direct vent device or as a vent free device.

16 Claims, 15 Drawing Sheets

(56) References Cited

U.S. PATENT DOCUMENTS

| | | | | |
|---|---|---|---|---|
| 2,160,264 | A | 5/1939 | Furlong | |
| 2,497,486 | A | 2/1950 | Barber | |
| 2,949,524 | A | 8/1960 | Scarioni | |
| 3,032,096 | A | 5/1962 | Stoui | |
| 3,387,600 | A | 6/1968 | Terzian | |
| 3,967,590 | A | 7/1976 | Hays et al. | |
| 4,010,728 | A | 3/1977 | Hempel et al. | |
| 4,076,011 | A | 2/1978 | Proulx | |
| 4,108,144 | A | 8/1978 | Wilhoite | |
| 4,157,238 | A | 6/1979 | Van Berkum | |
| 4,184,473 | A * | 1/1980 | McIntire | F23L 3/00 126/312 |
| 4,359,284 | A | 11/1982 | Kude et al. | |
| 4,373,507 | A * | 2/1983 | Schwartz | F23G 7/07 110/203 |
| 4,386,599 | A | 6/1983 | Berryhill | |
| 4,465,456 | A | 8/1984 | Hynek et al. | |
| 4,474,166 | A | 10/1984 | Shaftner et al. | |
| 4,686,891 | A | 8/1987 | Pouchard | |
| 4,768,947 | A | 9/1988 | Adachi | |
| 4,848,313 | A | 7/1989 | Velie | |
| 4,965,707 | A | 10/1990 | Butterfield | |
| 5,000,162 | A | 3/1991 | Shimek et al. | |
| 5,243,963 | A | 9/1993 | Riener | |
| 5,542,407 | A | 8/1996 | Hawkinson | |
| 5,642,580 | A | 7/1997 | Hess et al. | |
| 5,807,098 | A | 9/1998 | Deng | |
| 5,906,197 | A | 5/1999 | French et al. | |
| 5,937,139 | A | 8/1999 | Peterson | |
| 6,076,517 | A | 6/2000 | Kahlke et al. | |
| 6,145,502 | A * | 11/2000 | Lyons | F24B 1/1808 126/512 |
| 6,210,267 | B1 | 4/2001 | Long et al. | |
| 6,237,588 | B1 * | 5/2001 | Hawkinson | F24B 1/1808 126/500 |
| 6,244,223 | B1 | 6/2001 | Welk | |
| 6,327,427 | B1 | 12/2001 | Burkett | |
| 6,848,441 | B2 | 2/2005 | Bachinski et al. | |
| 6,959,144 | B2 | 10/2005 | Shimonoma | |
| 7,013,079 | B2 | 3/2006 | Ito et al. | |
| 7,013,886 | B2 | 3/2006 | Deng | |
| 7,422,011 | B2 | 9/2008 | Bachinski et al. | |
| 7,607,426 | B2 | 10/2009 | Deng | |
| 7,677,236 | B2 | 3/2010 | Deng | |
| 2002/0160325 | A1 | 10/2002 | Deng | |
| 2004/0011348 | A1 | 1/2004 | Bachinski et al. | |
| 2004/0109680 | A1 | 6/2004 | Ito et al. | |
| 2004/0151480 | A1 | 8/2004 | Ito et al. | |
| 2005/0036770 | A1 | 2/2005 | Ito et al. | |
| 2005/0139209 | A1 | 6/2005 | Deng | |
| 2005/0208443 | A1 | 9/2005 | Bachinski et al. | |
| 2008/0149872 | A1 | 6/2008 | Deng | |
| 2008/0223465 | A1 | 9/2008 | Deng | |
| 2009/0270023 | A1 | 10/2009 | Bartmann | |
| 2014/0045419 | A1 | 2/2014 | Bartmann | |

OTHER PUBLICATIONS

Napoleon, Park Avenue Installation and Operation Instructions, Jul. 20, 2006.

Napoleon, The Madison Installation and Operation Instructions, May 24, 2005.

* cited by examiner

HEATING APPARATUS WITH FAN

CROSS-REFERENCE TO RELATED APPLICATIONS

This application claims the benefit under 35 U.S.C. §119 (e) of U.S. Provisional Application Nos. 61/368,637, filed Jul. 28, 2010, and 61/408,549, filed Oct. 29, 2010, the entire contents of all of which are hereby incorporated by reference herein and made a part of this specification. U.S. Pat. No. 7,434,447, filed on May 30, 2006, is also hereby incorporated by reference herein and made a part of this specification.

BACKGROUND OF THE INVENTION

1. Field of the Invention

Certain embodiments disclosed herein relate generally to heating devices, and relate more specifically to fluid-fueled heating devices, such as, for example, gas heaters, fireplaces, stoves, and other heating devices.

2. Description of the Related Art

Many varieties of heaters, fireplaces, stoves, and other heating devices utilize pressurized, combustible fluid fuels to generate a desired heat output. Some such devices operate with liquid propane gas, while others operate with natural gas. These heating devices achieve high internal temperatures. However, such devices and certain components thereof have various limitations and disadvantages.

SUMMARY OF THE INVENTION

According to some embodiments, a gas fireplace assembly can comprise a sealed combustion chamber and a burner disposed within the combustion chamber. The combustion chamber can have a front face viewable to a user when the fireplace is in use. The gas fireplace assembly can also comprise a combustion air inlet in fluid communication with the sealed combustion chamber to provide air to the burner and an exhaust air outlet in fluid communication with the sealed combustion chamber to remove exhaust air from the combustion chamber. An outer housing can surround at least a portion of the sealed combustion chamber. A first air conduit can be positioned within the outer housing and configured to draw air into the first air conduit through a ventilation air inlet and to expel heated air out through a ventilation air outlet. The first air conduit can be in sufficient proximity to the sealed combustion chamber that air within the first air conduit is heated by said sealed combustion chamber. A combustion chamber front face air outlet can be positioned near the front face and configured to direct air from within the outer housing outside of the fireplace along and toward the front face of the sealed combustion chamber. A first fan can be positioned within the outer housing configured to direct air through the combustion chamber front face air outlet along and toward the front face of the sealed combustion chamber to thereby cool the front face.

In some embodiments, a gas fireplace assembly has a sealed combustion chamber, having a front face viewable to a user when the fireplace is in use; a burner disposed within said combustion chamber; a combustion air inlet in fluid communication with the sealed combustion chamber and configured to provide air to the burner; an exhaust air outlet in fluid communication with the sealed combustion chamber and configured to remove exhaust air from the combustion chamber; an outer housing surrounding at least a portion of the sealed combustion chamber; a ventilation air inlet; a ventilation air outlet; a first air conduit positioned within the outer housing and configured to draw air into the first air conduit through the ventilation air inlet and to expel heated air out through the ventilation air outlet, the first air conduit being in sufficient proximity to said sealed combustion chamber that air within said first air conduit is heated by said sealed combustion chamber; a front face channel positioned along a bottom of the front face and configured to direct air along the front face of the sealed combustion chamber; and a first fan positioned to direct air through the front face channel to the front face of the sealed combustion chamber to thereby cool the front face.

In some embodiments, a heating apparatus can include a sealed combustion chamber; a glass portion comprising a face of said sealed combustion chamber; a climate control air inlet; a first fan in fluid communication with said climate control air inlet and configured to deliver air to said glass portion; a combustion air inlet in fluid communication with said sealed combustion chamber; a combustion air exhaust in fluid communication with said sealed combustion chamber; and a climate control air exhaust wherein air enters the heating apparatus at a first temperature and exits the climate control air exhaust at a second temperature, and the second temperature is greater than the first temperature.

In some embodiments, a gas fireplace assembly can have a sealed combustion chamber having a door; a first burner disposed within said combustion chamber; an air inlet; a first air conduit in fluid communication with said air inlet and in sufficient proximity to said sealed combustion chamber that air within said first air conduit can be warmed by said sealed combustion chamber; a combustion air conduit in fluid communication with said sealed combustion chamber and configured to route combustion air to said sealed combustion chamber; a combustion air exhaust having an opening in fluid communication with said sealed combustion chamber and configured to remove exhaust air from said sealed combustion chamber; a cover configured to removably cover said opening of said combustion air exhaust, said cover operably connected to said door, such that opening said door causes the cover to move to a closed position covering said opening and closing said door causes said cover to move to an open position uncovering said opening; wherein said cover and said door are configured to convert said gas fireplace assembly from a first configuration to a second configuration; and wherein said first configuration vents combustion exhaust to an exterior of a structure and said second configuration vents combustion exhaust to an interior of a structure.

According to certain embodiments, a gas fireplace assembly can comprise a sealed combustion chamber, a first burner disposed within said combustion chamber, a fluid inlet, and a first fluid conduit in fluid communication with said fluid inlet and in sufficient proximity to said sealed combustion chamber that fluid within said first fluid conduit can be warmed by said sealed combustion chamber. The gas fireplace assembly can further comprise a combustion fluid conduit in fluid communication with said sealed combustion chamber and configured to route combustion fluid to said sealed combustion chamber, a cover configured to cover said combustion fluid conduit, and a face of said sealed combustion chamber, a portion of said face being removable therefrom. The cover and said removable face are configured to convert said gas fireplace assembly from a first configuration to a second configuration and said first configuration vents combustion exhaust to an exterior of a structure and said second configuration vents combustion exhaust to an interior of a structure.

In some embodiments, a gas fireplace assembly can comprise a sealed combustion chamber, a burner disposed within said combustion chamber, a fluid inlet, and a first fluid conduit in fluid communication with said fluid inlet and in sufficient proximity to said sealed combustion chamber that fluid within said first fluid conduit can be warmed by said sealed combustion chamber. The gas fireplace assembly can further comprise a combustion fluid conduit in fluid communication with said sealed combustion chamber and configured to route combustion fluid to said sealed combustion chamber, a fluid outlet in fluid communication with said first fluid conduit, wherein fluid heated by combustion within said sealed combustion chamber is expelled from said first fluid conduit through said fluid outlet, and a sensor configured to indicate reduced oxygen levels.

In some embodiments, a gas fireplace assembly can comprise a sealed combustion chamber, a burner disposed within said combustion chamber, a fluid inlet, a first fluid conduit in fluid communication with said fluid inlet and in sufficient proximity to said sealed combustion chamber that fluid within said first fluid conduit can be warmed by said sealed combustion chamber, and a first fan which exhausts fluid toward an exterior surface of a face of said sealed combustion chamber. The gas fireplace assembly can further comprise a combustion fluid conduit in fluid communication with said sealed combustion chamber and configured to route combustion fluid to said sealed combustion chamber, a second fan which exhausts combustion fluid toward an interior surface of said face of said sealed combustion chamber, and a fluid outlet in fluid communication with said first fluid conduit, wherein fluid heated by combustion within said sealed combustion chamber is expelled from said first fluid conduit through said fluid outlet.

In some embodiments, a gas fireplace assembly can comprise a sealed combustion chamber, a glass portion comprising a face of said sealed combustion chamber, a climate control air inlet, a first fan in fluid communication with said climate control air inlet and configured to deliver air to said glass portion, and a combustion air inlet in fluid communication with said sealed combustion chamber. The gas fireplace assembly can further comprise a combustion air exhaust in fluid communication with said sealed combustion chamber, and a climate control air exhaust wherein air enters the heating apparatus at a first temperature and exits the climate control air exhaust at a second temperature, and the second temperature is greater than the first temperature. The heating apparatus is operable in a first configuration and a second configuration.

In some embodiments, a gas fireplace assembly can comprise a sealed combustion chamber, a burner disposed within the combustion chamber, a fluid inlet, a first fluid conduit in fluid communication with the fluid inlet and in sufficient proximity to the sealed combustion chamber that fluid within the first fluid conduit can be warmed by the sealed combustion chamber. The gas fireplace assembly can further comprise a first fan which exhausts fluid toward a front face of the sealed combustion chamber, a combustion fluid conduit in fluid communication with the sealed combustion chamber and configured to route combustion fluid to the sealed combustion chamber, and a fluid outlet in fluid communication with the first fluid conduit, wherein fluid heated by combustion within the sealed combustion chamber is expelled from the first fluid conduit through the fluid outlet. In some embodiments, the combustion chamber can be unsealed.

In some embodiments, a heating apparatus can comprise a sealed combustion chamber, a glass portion comprising a front face of the sealed combustion chamber, a climate control air inlet, and a first fan in fluid communication with the climate control air inlet and configured to deliver air to the glass portion. The heating apparatus can further comprise a combustion air inlet in fluid communication with the sealed combustion chamber, a combustion air exhaust in fluid communication with the sealed combustion chamber, and a climate control air exhaust wherein air enters the heating apparatus at a first temperature and exits the climate control air exhaust at a second temperature, and the second temperature is greater than the first temperature.

In some embodiments, a gas fireplace assembly cooling structure can comprise a first fan, an air source, and a fluid outlet. The cooling structure can be configured to cool exterior surfaces of a gas fireplace that are subject to elevated temperatures from the heat output of a fireplace assembly burner. The cooling structure can further comprise the first fan in fluid communication with the air source, and the fluid conduit in fluid communication with the first fan and a fluid outlet. The cooling fluid outlet is directed to an external glass surface on a front face of the fireplace assembly, and the first fan can pump convection cooling air over the surface of the front face glass surface to achieve a reduced temperature external surface.

BRIEF DESCRIPTION OF THE DRAWINGS

In order to better understand the embodiments of the disclosure and to see how it may be carried out in practice, some preferred embodiments are next described, by way of non-limiting examples only, with reference to the accompanying drawings, in which like reference characters denote corresponding features consistently throughout similar embodiments in the attached drawings.

DETAILED DESCRIPTION OF THE PREFERRED EMBODIMENT

Figure 1:
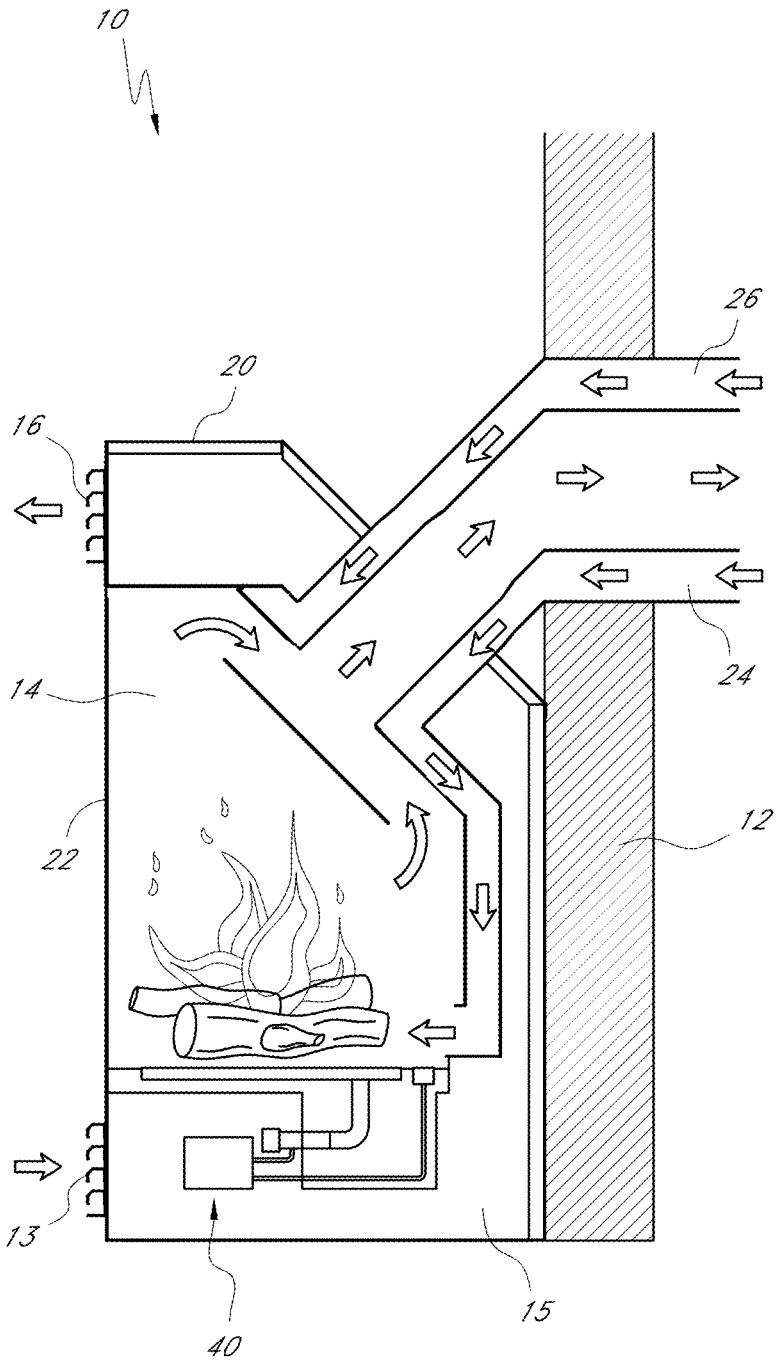
FIG. 1 is a schematic view of a heating device.

Many varieties of space heaters, wall heaters, stoves, fireplaces, fireplace inserts, gas logs, and other heat-producing devices employ combustible fluid fuels, such as liquid propane and natural gas. The term "fluid," as used herein, is a broad term used in its ordinary sense, and includes materials or substances capable of fluid flow, such as, for example, one or more gases, one or more liquids, or any combination thereof. Fluid-fueled units, such as those listed above, generally are designed to operate with a single fluid fuel type at a specific pressure or within a range of pressures. For example, some fluid-fueled heaters that are configured to be installed on a wall or a floor operate with natural gas at a pressure in a range from about 3 inches of water column to about 6 inches of water column, while others are configured to operate with liquid propane at a pressure in a range from about 8 inches of water column to about 12 inches of water column. Similarly, some gas fireplaces and gas logs are configured to operate with natural gas at a first pressure, while others are configured to operate with liquid propane at a second pressure that is different from the first pressure. As used herein, the terms "first" and "second" are used for convenience, and do not connote a hierarchical relationship among the items so identified, unless otherwise indicated.

Direct vent fireplaces provide efficient heating and do not require a chimney for operation. A direct vent fireplace can direct external ambient air through a combustion vent system for heat generating combustion, and thus does not deprive interior living spaces of oxygen or heated air. Direct vent fireplaces use a balanced flow of combustion air and exhaust gas moving through the combustion fluid intake and exhaust ducts to provide an aesthetically desirable flame in the firebox. Desirable flame characteristics can include, for example, appearing similar to a natural wood-fire flame. The size, color and action of the flames in the firebox can be adjusted by selectively balancing the flow of combustion air and exhaust gas. A balanced flow also allows direct vent fireplaces to function in a thermally efficient manner. Accordingly, an important part of the fireplace insert's installation is to properly balance the combustion air intake flow and the exhaust gas flow. A direct vent fireplace can also provide heat via radiant energy transmitted through the glass enclosure of the fireplace front face. In addition, the combustion chamber enclosure structure reaches elevated temperatures during fireplace operation, e.g. the firebox, glass window, or the like. The combustion chamber of a direct vent fireplace is desirably "sealed." As will be appreciated by those of skill in the art, as used herein a "sealed combustion chamber" is sealed to the extent that it effectively seals the space desired to be heated (usually an interior room) from (1) air from an external source (usually ambient air from outdoors to be used in the combustion process and (2) exhaust created from the combustion process.

In addition, in some instances, the appearance of a flame produced by some fluid-fueled units is important to the marketability of the units. For example, some gas fireplaces and gas fireplace inserts are desirable as either replacements for or additions to natural wood-burning fireplaces. Such replacement units can desirably exhibit enhanced efficiency, improved safety, and/or reduced mess. In many instances, a flame produced by such a gas unit desirably resembles that produced by burning wood, and thus preferably has a substantially yellow hue.

The amount of oxygen present in the fuel at a combustion site of a unit (e.g., at a burner) can affect the color of the flame produced by the unit. Accordingly, in some units, one or more components of the unit are adjusted to regulate the amount of air that is mixed with the fuel to create a proper air/fuel mixture at the burner. Such adjustments can be influenced by the pressure at which the fuel is dispensed.

The conventional insert-style fireplace insert is typically installed and balanced by first sliding the insert into a close-fit fireplace cavity so a limited access space is provided between the fireplace insert and the cavity's walls. The installer reaches through the limited access space to connect the fireplace insert to the exhaust duct and the intake duct. The installer then balances the flow of combustion air and the exhaust gas while the fire is burning in the firebox in order to visually analyze the flame characteristics. Limited access to the adjustment mechanisms for the intake duct, the exhaust duct or an air shutter can make this balancing a time-consuming and labor intensive process requiring multiple adjustments of the adjustment mechanisms during installation.

Some fluid-fueled fireplace units generate hot surfaces about the various features of the fireplace. For example, fireplaces having a sealed, or semi-sealed, or partially sealed window or viewing space on the front face of the unit can reach unsafe temperatures due to the risk of burning the skin, or igniting other objects in close proximity to or touching such a surface. In addition, thermal cycling experienced by the viewing space structure, or glass window, subjects the glass to increased loads that can reduce the durability of the structure. The proximity of the glass portion of a front face to the intense heat emitted by the fireplace burner increases these types of concerns and the maintenance costs of the gas fireplace.

Certain embodiments disclosed herein reduce or eliminate one or more of the foregoing problems associated with existing fluid-fueled devices and/or provide some or all of the desirable features detailed herein. Although certain embodiments discussed herein are described in the context of directly vented heating units, such as fireplaces and fireplace inserts, it should be understood that certain features, principles, and/or advantages described are applicable in a much wider variety of contexts, including, for example, vent-free heating units, gas logs, heaters, heating stoves, cooking stoves, barbecue grills, water heaters, and any flame-producing and/or heat-producing fluid-fueled unit or appliance, including without limitation units that include a burner of any suitable variety.

Direct Vent Fireplace

Figure 2:
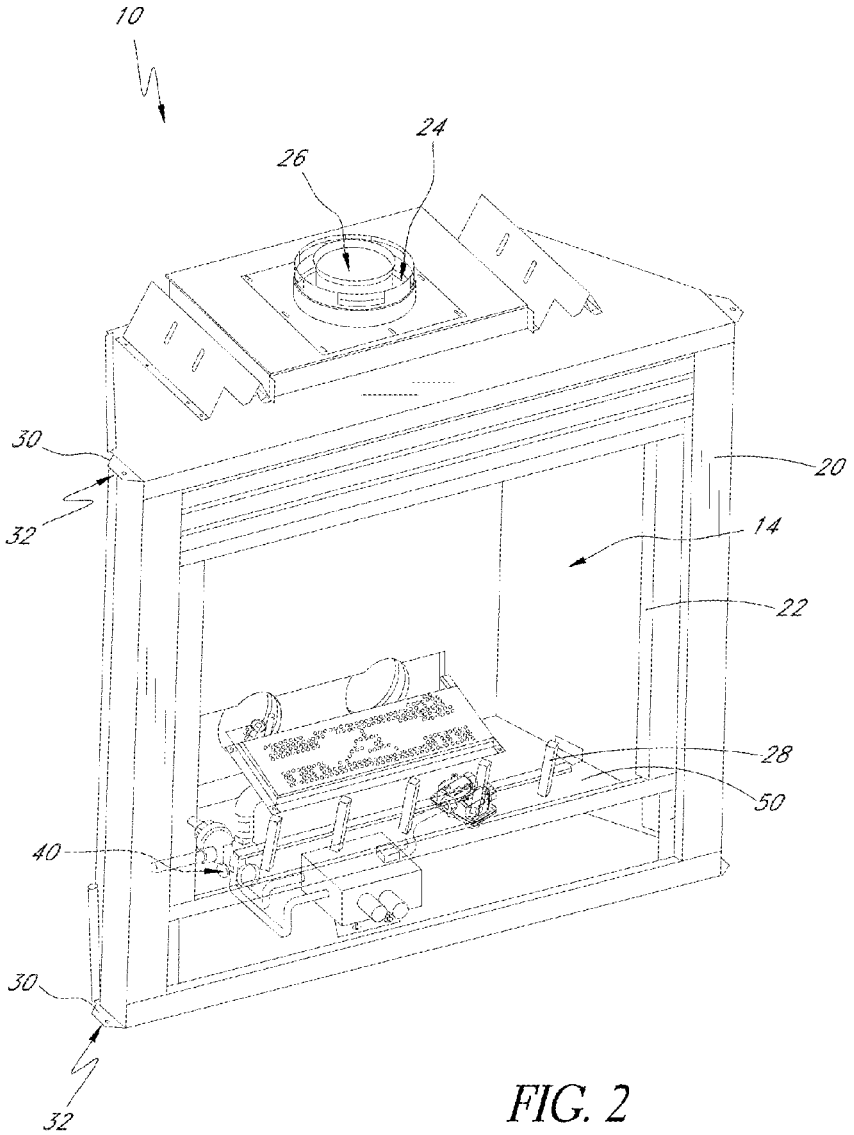
FIG. 2 is a perspective view of an embodiment of a heating device.

For clarity and convenience, a direct vent fireplace without the cooling structure discussed above will first be described with reference to FIGS. 1-5. It will be understood that one or more of the features of the fireplaces of FIGS. 1-2A and 3-5 could be used in other embodiments of the fireplaces discussed herein, such as the fireplaces of FIGS. 6-7 and FIGS. 8-11. FIGS. 1 and 2 illustrate an embodiment of a fireplace, fireplace insert, heat-generating unit, or heating device 10 configured to operate with a source of combustible fuel. In various embodiments, the heating device 10 is configured to be installed within a suitable cavity, such as the firebox of a fireplace or a dedicated outer casing. The heating device 10 can extend through a wall 12, in some embodiments.

The heating device 10 includes a housing 20. The housing 20 can include metal or some other suitable material for providing structure to the heating device 10 without melting or otherwise deforming in a heated environment. The housing 20 can define a window 22. In some embodiments, the window 22 comprises a sheet of substantially clear material, such as tempered glass, that is substantially impervious to heated air but substantially transmissive to radiant energy.

The heating device 10 can include a sealed chamber 14. The sealed chamber 14 can be sealed to the outside with the exception of the air intake 24 and the exhaust 26. Heated air does not flow from the sealed chamber to the surroundings; instead air, for example from in an interior room, can enter an inlet vent 13 into the housing 20. The air can pass through the housing in a conduit, or channel 15, passing over the outside of the sealed chamber 14 and over the exhaust 26. Heat can be transferred to the air which can then pass into the interior room through outlet vent 16.

In some embodiments, the heating device 10 includes a grill, rack, or grate 28, as in FIG. 2. The grate 28 can provide a surface against which artificial logs may rest, and can resemble similar structures used in wood-burning fireplaces. In certain embodiments, the housing 20 defines one or more mounting flanges 30 used to secure the heating device 10 to a floor and/or one or more walls. The mounting flanges 30 can include apertures 32 through which mounting hardware can be advanced. Accordingly, in some embodiments, the housing 20 can be installed in a relatively fixed fashion within a building or other structure.

As shown, the heating device 10 includes a fuel delivery system 40, which can have portions for accepting fuel from a fuel source, for directing flow of fuel within the heating device 10, and for combusting fuel. In the embodiment illustrated in FIG. 2, portions of an embodiment of the fuel delivery system 40 that would be obscured by the heating device 10 are shown in phantom. Specifically, the illustrated heating device 10 includes a floor 50 which forms the bottom of the sealed combustion chamber 14 and the components shown in phantom are positioned beneath the floor 50.

Figure 2A:
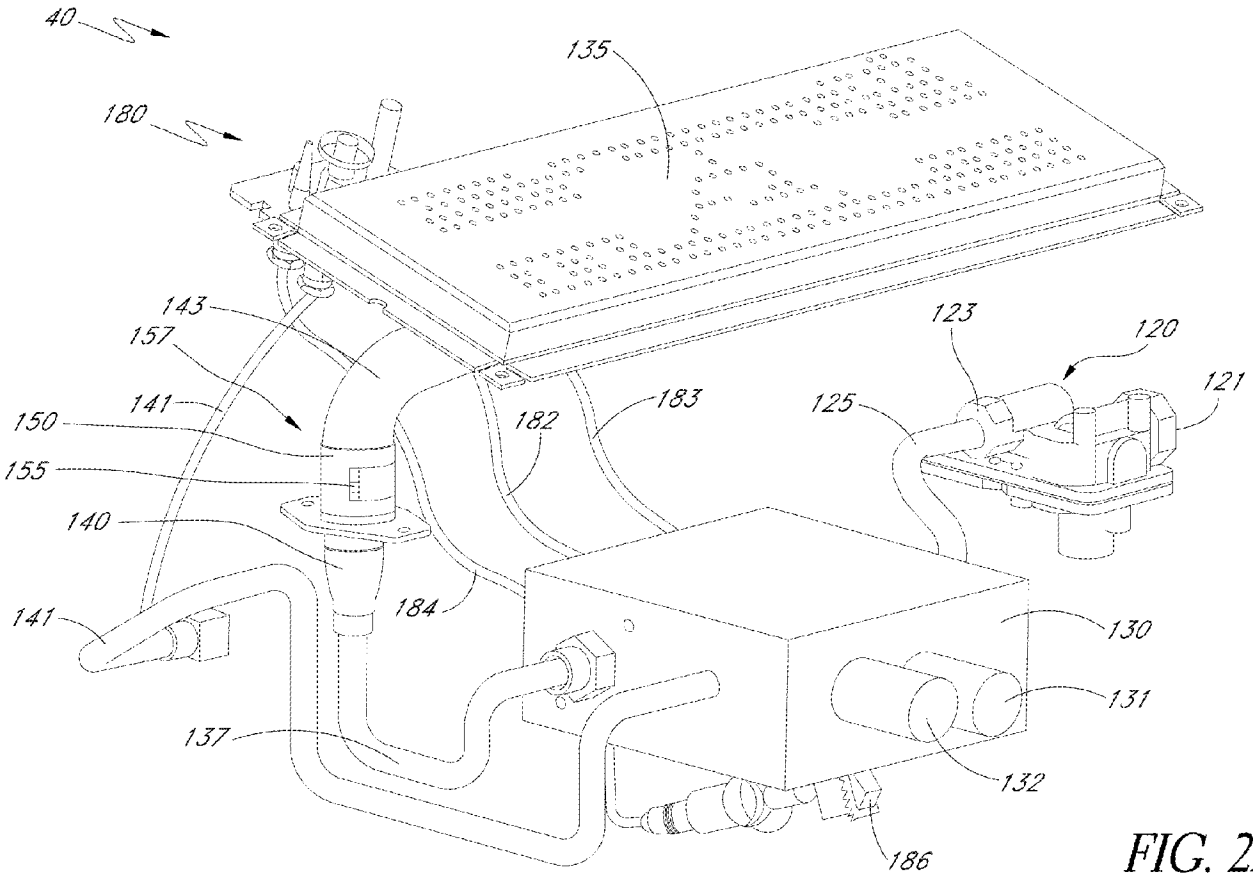
FIG. 2A is a perspective view of an embodiment of a fuel delivery system compatible with the heating device of FIG. 2.

With reference to FIG. 2A, an example of a fuel delivery system is shown. The fuel delivery system 40 can include a regulator 120. The regulator 120 can be configured to selectively receive a fluid fuel (e.g., propane or natural gas) from a source at a certain pressure. In certain embodiments, the regulator 120 includes an input port 121 for receiving the fuel. The regulator 120 can define an output port 123 through which fuel exits the regulator 120. Accordingly, in many embodiments, the regulator 120 is configured to operate in a state in which fuel is received via the input port 121 and delivered to the output port 123. In certain embodiments, the regulator 120 is configured to regulate fuel entering the port 121 such that fuel exiting the output port 123 is at a relatively steady pressure. The regulator 120 can function in ways similar to the pressure regulators disclosed in U.S. Pat. No. 7,434,447, filed on May 30, 2006, and incorporated by reference herein.

The output port 123 of the regulator 120 can be coupled with a source line or channel 125. The source line 125, and any other fluid line described herein, can comprise piping, tubing, conduit, or any other suitable structure adapted to direct or channel fuel along a flow path. In some embodiments, the source line 125 is coupled with the output port 123 at one end and is coupled with a control valve 130 at another end. The source line 125 can thus provide fluid communication between the regulator 120 and the control valve 130.

The control valve 130 can be configured to regulate the amount of fuel delivered to portions of the fuel delivery system 40. Various configurations of the control valve 130 are possible, including those known in the art as well as those yet to be devised. In some embodiments, the control valve 130 includes a millivolt valve. The control valve 130 can comprise a first knob or dial 131 and a second dial 132. In some embodiments, the first dial 131 can be rotated to adjust the amount of fuel delivered to a burner 135, and the second dial 132 can be rotated to adjust a setting of a thermostat. In other embodiments, the control valve 130 comprises a single dial 131.

In many embodiments, the control valve 130 is coupled with a burner transport line or channel 137 and a pilot transport or delivery line 141. The burner transport line 137 can be coupled with a nozzle assembly 140 which can be further coupled with a burner delivery line 143. The nozzle assembly 140 can be configured to direct fuel received from the burner transport line 132 to the burner delivery line or channel 143.

The pilot delivery line 141 is coupled with a safety pilot, pilot assembly, or pilot 180. Fuel delivered to the pilot 180 can be combusted to form a pilot flame, which can serve to ignite fuel delivered to the burner 135 and/or serve as a safety control feedback mechanism that can cause the control valve 130 to shut off delivery of fuel to the fuel delivery system 40. Additionally, in some embodiments, the pilot 180 is configured to provide power to the control valve 130. Accordingly, in some embodiments, the pilot 180 is coupled with the control valve 130 by one or more of a feedback line 182 and a power line 183.

The pilot 180 can comprise an igniter or an electrode configured to ignite fuel delivered to the pilot 180 via the pilot delivery line 141. Accordingly, the pilot 180 can be coupled with an igniter line 184, which can be connected to an igniter actuator, button, or switch 186. In some embodiments, the igniter switch 186 is mounted to the control valve 130. In other embodiments, the igniter switch 186 is mounted to the housing 20 of the heating device 10. The pilot 180 can also comprise a thermocouple. Any of the lines 182, 183, 184 can comprise any suitable medium for communicating an electrical quantity, such as a voltage or an electrical current. For example, in some embodiments, one or more of the lines 182, 183, 184 comprise a metal wire.

The burner delivery line 143 is situated to receive fuel from the nozzle assembly 140, and can be connected to the burner 135. The burner 135 can comprise any suitable burner, such as, for example, a ceramic tile burner or a blue flame burner, and is preferably configured to continuously combust fuel delivered via the burner delivery line 143.

The flow of fuel through the fuel delivery system 40, as shown, will now be described. A fuel is introduced into the fuel delivery system 40 through the regulator 120 which then proceeds from the regulator 120 through the source line or channel 125 to the control valve 130. The control valve 130 can permit a portion of the fuel to flow into the burner transport line or channel 132, and can permit another portion of the fuel to flow into the pilot transport line or channel 141. The fuel flow in the burner transport line 132 can proceed to the nozzle assembly 140. The nozzle assembly 140 can direct fuel from the burner transport line or channel 132 into the burner delivery line or channel 143. In some embodiments, fuel flows through the pilot delivery line or channel 141 to the pilot 180, where it is combusted. In some embodiments, fuel flows through the burner delivery line or channel 143 to the burner 135, where it is combusted.

An air shutter 150 can also be along the burner delivery line 143. The air shutter 150 can be used to introduce air into the flow of fuel prior to combustion at the burner 135. This can create a mixing chamber 157 where air and fuel is mixed together prior to passing through the burner delivery line 143 to the burner 135. The amount of air that is needed to be introduced can depend on the type of fuel used. For example, propane gas at typical pressures needs more air than natural gas to produce a flame of the same size.

The air shutter 150 can be adjusted by increasing or decreasing the size of a window 155. The window 155 can be configured to allow air to pass into and mix with fuel in the burner delivery line 143.

The air shutter 150, along with the burner 135 and the pilot 180 can be within the sealed combustion chamber 14. Because the combustion chamber 14 is sealed, it can be difficult to access components within the combustion chamber 14. For this reason some of the components are within the combustion chamber 14 but many are not. In some embodiments, only the components necessary for combustion are within the chamber 90 and all others are outside the chamber 14. For example, the other components can be in the channel 15 of the housing 20 (FIG. 1). It is necessary for connecting pipes, lines or channels and some parts of other components to pass into the sealed combustion chamber 14 and remain partially inside the sealed combustion chamber 14 and partially outside. Fittings can be used to allow the necessary components to pass into the chamber 14 while otherwise sealing the entry point into the sealed combustion chamber 14.

As the air shutter 150 is within the sealed combustion chamber 14, it can be difficult to adjust to the proper setting. In some currently available heaters, a long screw is used to adjust the air shutter. The long screw passes into the sealed combustion chamber through a fitting and the end attaches to the air shutter. Advancing or withdrawing the screw into or out of the sealed combustion chamber can move the air shutter to adjust the size of the window. A long screw can be cumbersome and does not provide any indication to the user as to the position of the air shutter.

Figure 3:
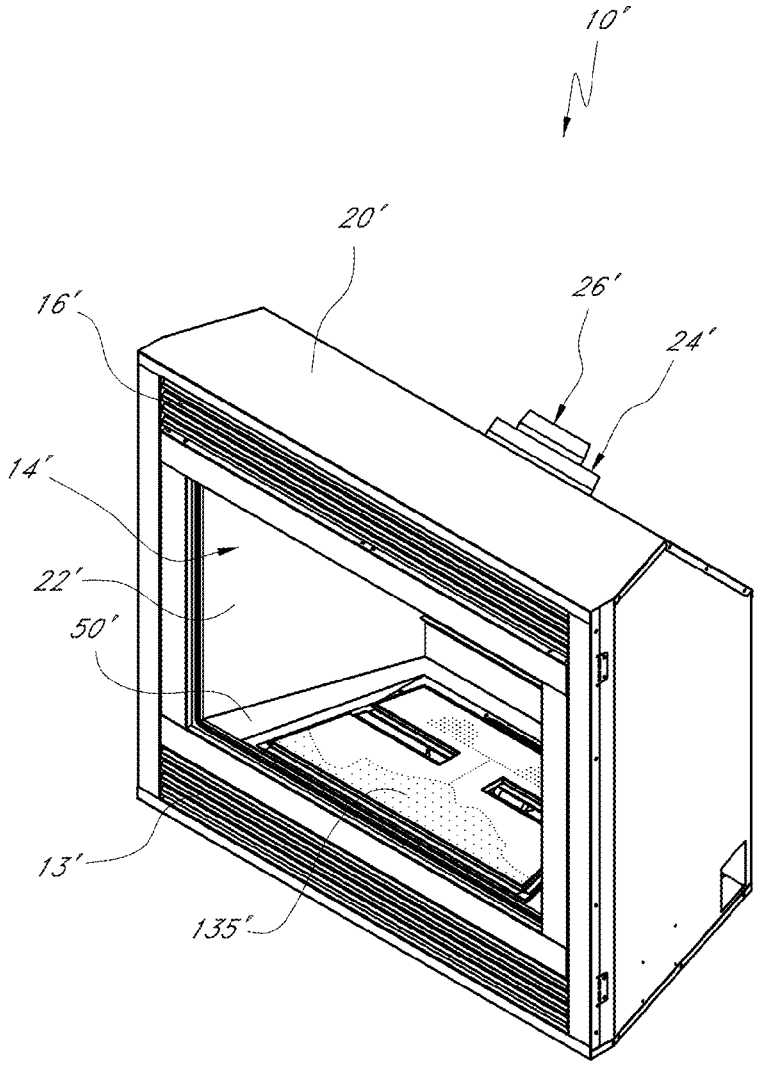
FIG. 3 is a perspective view of another embodiment of a heating device.
Figure 3A:
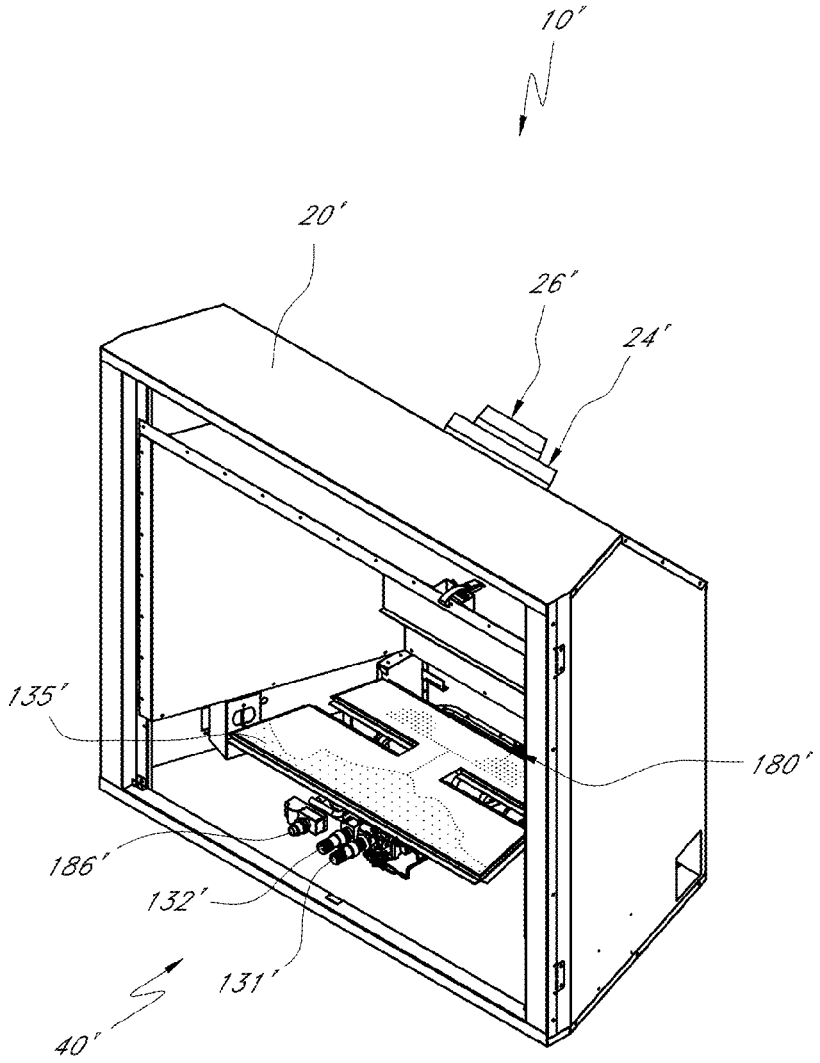
FIG. 3A is a partially disassembled perspective view of the heating device of FIG. 3.
Figure 3B:
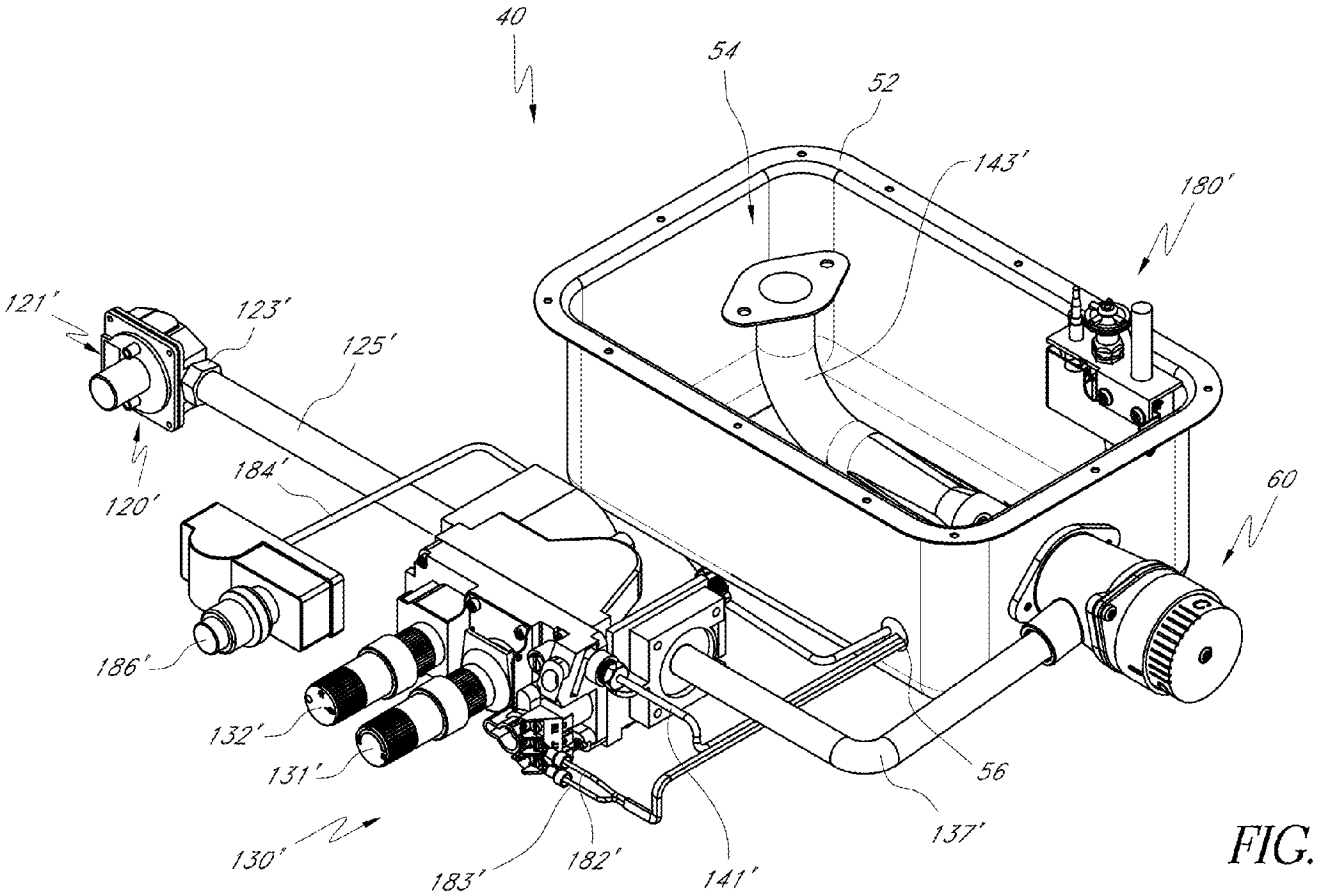
FIG. 3B is a perspective view of an embodiment of a fuel delivery system compatible with the heating device of FIG. 3.

FIGS. 3, 3A and 3B illustrate another embodiment of a heating device 10' and a fuel delivery system 40' compatible with the heating device 10'. Numerical reference to components is the same as previously described, except that a prime symbol (') has been added to the reference. Where such references occur, it is to be understood that the components are the same or substantially similar to previously-described components.

As can be seen in FIG. 3, a direct vent heating device 10' can have a housing 20' which encloses a sealed chamber 14' with a burner 135' inside the sealed chamber. FIG. 3A shows the heating device 10' in a partially disassembled view. For example, part of the outer housing 20', such as vents 13', 16' have been removed, as has the floor 50'. This view shows some of the components of the heating device 10', such as parts of the fuel delivery system 40'.

Turning now to FIG. 3B an embodiment of a fuel delivery system 40' is shown that can be compatible with many different heating devices including the heating device shown in FIG. 3. The fuel delivery system 40' can include many of the components previously described with respect to FIG. 2A, such as a pilot assembly 180', an igniter 186' and a control valve 130'.

Also shown in FIG. 3B is a basket 52. The inner portion 54 of the basket 52 can be part of the sealed chamber 14'. The basket 52 can be used to store certain parts of the heating device such as components of the fuel delivery system 40' within the sealed chamber 14'. The basket 52 can also attach to the floor 50' and can be configured to allow certain components, pipes, wires, etc. to pass through the basket 52. Gaskets 56 can be used to seal access points into the basket 52, floor 50' or other parts of the sealed chamber 14'.

FIGS. 4A-E illustrate one embodiment of an improved air shutter control 60. In some embodiments, the air shutter control 60 can replace the nozzle assembly 140 in FIG. 2A, similar to the configuration shown in FIG. 3B. The burner transport line 137' can connect to an inlet 62 on the air shutter control 60. Fuel can be directed from the inlet 62 through a valve 64 to an injector orifice or nozzle 66. The fuel can be injected into the mixing chamber 157' to mix with air introduced through the air shutter 150' to pass into the burner delivery line 143' to then be delivered to the burner 135' for combustion.

Figure 5:
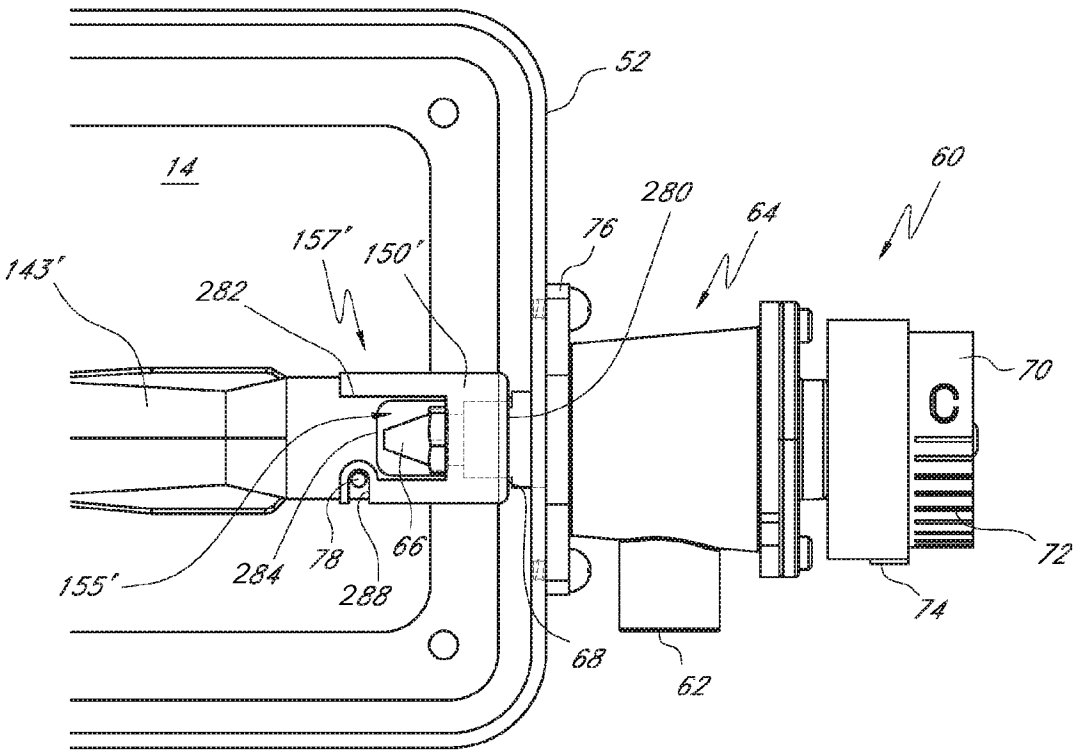
FIG. 5 shows the air shutter control of FIGS. 4A-D attached to an air shutter.

Looking now at FIG. 5, as shown, an air shutter 150' can comprise a cylinder or other shape with a slot 280 sized to fit on ledge 68 of the valve 64. The air shutter 150' can be configured to move with the valve 64. In some embodiments, the air shutter 150' can be fastened on to the valve 64 either at the ledge 68 or otherwise. This can be done, for example, with a friction fit between the slot 280 and the ledge 68. In some embodiments, the nozzle 66 can also be configured to move with the valve. In some embodiments, the valve 64, the nozzle 66 and the air shutter 150' all rotate about the same axis. In some embodiments, the nozzle 66 and the air shutter 150' are coaxial.

The air shutter 150' can also have a slot or hole 282. In some embodiments, the burner delivery line 143' has a corresponding slot or hole 284. The overlap between the holes 282 and 284 can create a window 155' that can allow air to pass into the mixing chamber 157' to mix with the fuel.

The air shutter control 60 can have a user interface surface 70. The user interface surface 70 can be used to control the position of the air shutter 150' and conversely the amount of air that can enter the mixing chamber 157'. The user interface surface 70 can comprise a knob connected to the valve 64. In other embodiments, not shown, the user interface surface 70 can comprise other types of mechanical controls such as a lever, a wheel, a switch, or some other device to transfer a user's movement to move the air shutter 150'. In other embodiments, also not shown, the user interface surface 70 can comprise an electrical or computer control, including but not limited to electrical buttons, electrical switches, a touch screen, etc. Additional details of the air shutter 150 and the air shutter control are disclosed in U.S. patent application Ser. No. 12/797,446, now U.S. Pat. No. 8,506,290, which is hereby incorporated by reference in its entirety.

The user interface surface 70 can be rotated from a first position to a second position. The different positions of the user interface surface 70 can result in the window 155' ranging from fully open or substantially fully open to fully closed or substantially fully closed. In some embodiments it can be undesirable to fully close or substantially fully close the window, therefore the position may result in a window that is just short of being fully closed or substantially fully closed.

The air shutter 150' can be set at the factory to an initial position. The factory setting can be a typical setting of the air shutter 70 known to work in many typical situations. The position can be indicated on the user interface surface 70. For example, markings 72 on the user interface surface 70 and an indicator 74 can indicate to a user a position of the air shutter 150'. The indicator 74 can point to a marking 72 to show the position. In some embodiments, the markings 72 can show a relative position of the air shutter 150' between the open and closed positions. In other words, the markings 72 can indicate to a user an increase or decrease in the size of the window 155' and thereby an increase or decrease in the amount of air that can mix with the fuel flow.

If needed, a user, such as an installer, can rotate the user interface surface 70 to change the position of the air shutter 150'. The new position can be indicated on the user interface surface 70. Thus, fine tune adjustment of the air shutter 150' can be provided.

According to some embodiments, the user interface surface 70 can be outside of the sealed combustion chamber 14' and the air shutter 150' can be inside of the sealed combustion chamber 14'. For example, the flange 76 can be used as a fitting to attach the air shutter control 60 to a basket 52 or to a wall of or the floor 50' of the sealed combustion chamber 14'. The injector orifice 66 and the part of the valve attached to the air shutter can be inside the sealed combustion chamber 14' while the rest of the valve, the flange 76 and the user interface surface 70 can be outside of the sealed combustion chamber 14'.

Thus, advantageously the air shutter control 60 can pass into the sealed combustion chamber through the same entry point as the flow of fuel going to the burner 135'. This reduces the number of entry points into the sealed combustion chamber 14 which also reduces the number of fittings or gaskets required to the maintain the seal on the sealed combustion chamber 14.

Figure 4C:
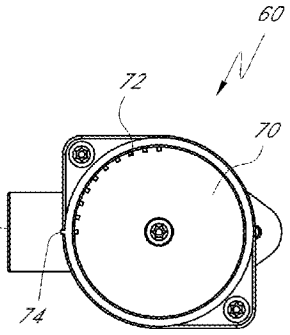
FIGS. 4A-D show front, side, back and top views of an embodiment of an air shutter control.
Figure 4B:
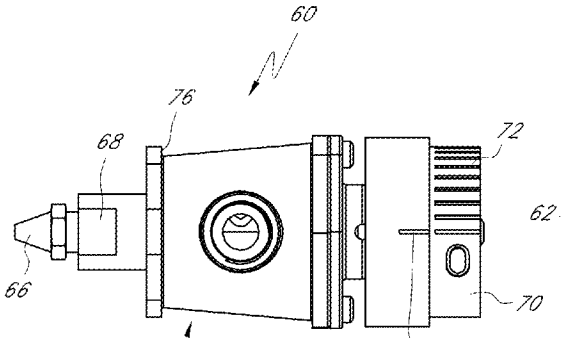
Figure 4D:
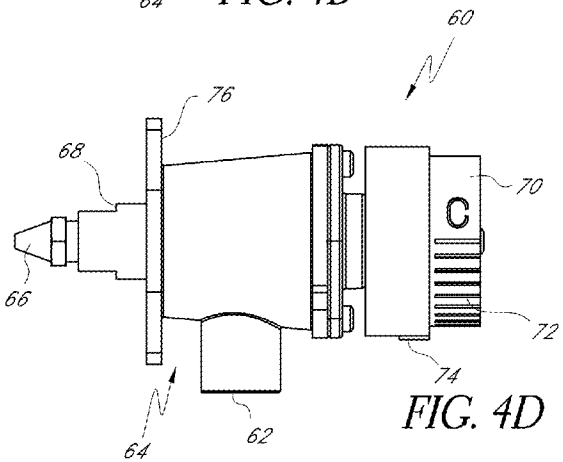
Figure 4A:
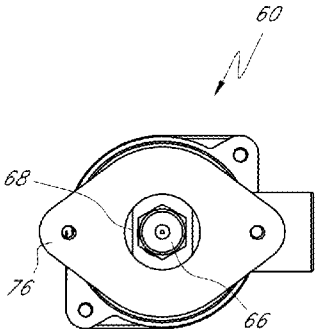
Figure 4E:
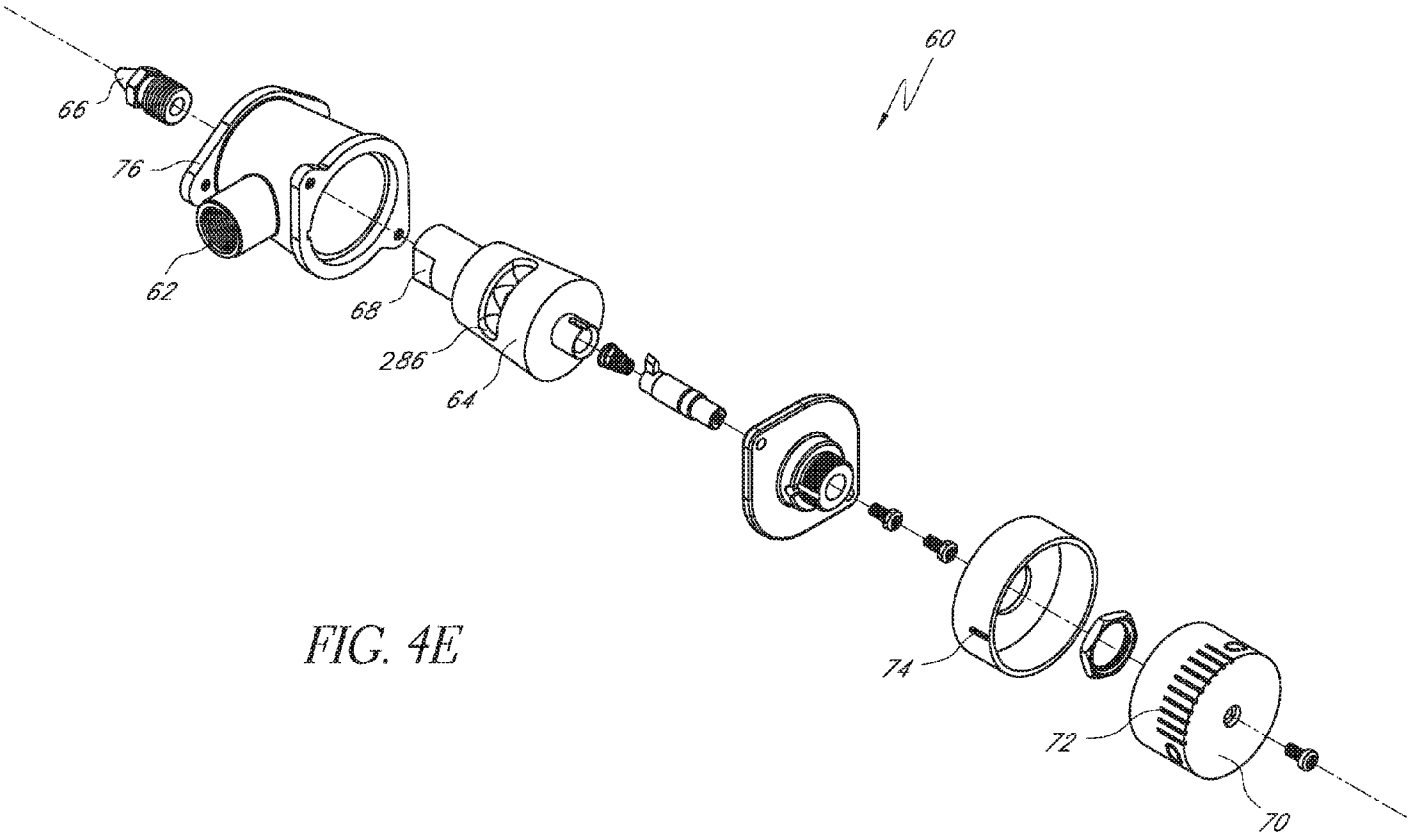
FIG. 4E shows an exploded view of the air shutter control of FIGS. 4A-D.

For the valve 64 to be able to have a large range of motion without affecting the amount of fuel flowing into the valve 64, an enlarged entry port 286 is provided (FIG. 4E). The enlarged entry port 286 is larger than the inlet 62. Thus, fuel can flow into the inlet 62 and then into the enlarged entry port 286 through a full range of movements of the valve 64. The enlarged entry port 286 desirably results in permitting significant flow over a range of motion corresponding to the desired range of motion for the air shutter, for example, at least 15 degrees, 30 degrees, 45 degrees, 60 degrees, 90 degrees and 105 degrees.

The air shutter control 60 can also have a limiting device or mechanism to limit the range of motion of the air shutter and/or the air shutter control. For example, FIG. 5 shows a slot 288 in the air shutter 150' and a peg 78 in the slot 288. The peg 78 can allow the air shutter 150' to rotate until the one side of the slot 288 contacts the peg 78 wherein further movement is prevented.

Direct Vent Fireplace with Cooling Structure

The embodiments described in FIGS. 1-5 disclose a gas fireplace assembly with several control system embodiments to control the performance parameters of the gas fireplace. Although the description of the embodiments of FIGS. 6 and 7 provided below do not include specific details of a control system, it is understood that the following direct vent fireplace with cooling structure embodiments can include any of the above described control systems, in whole or in part, and any combination thereof of the various components or features of the control systems described above.

Figure 6:
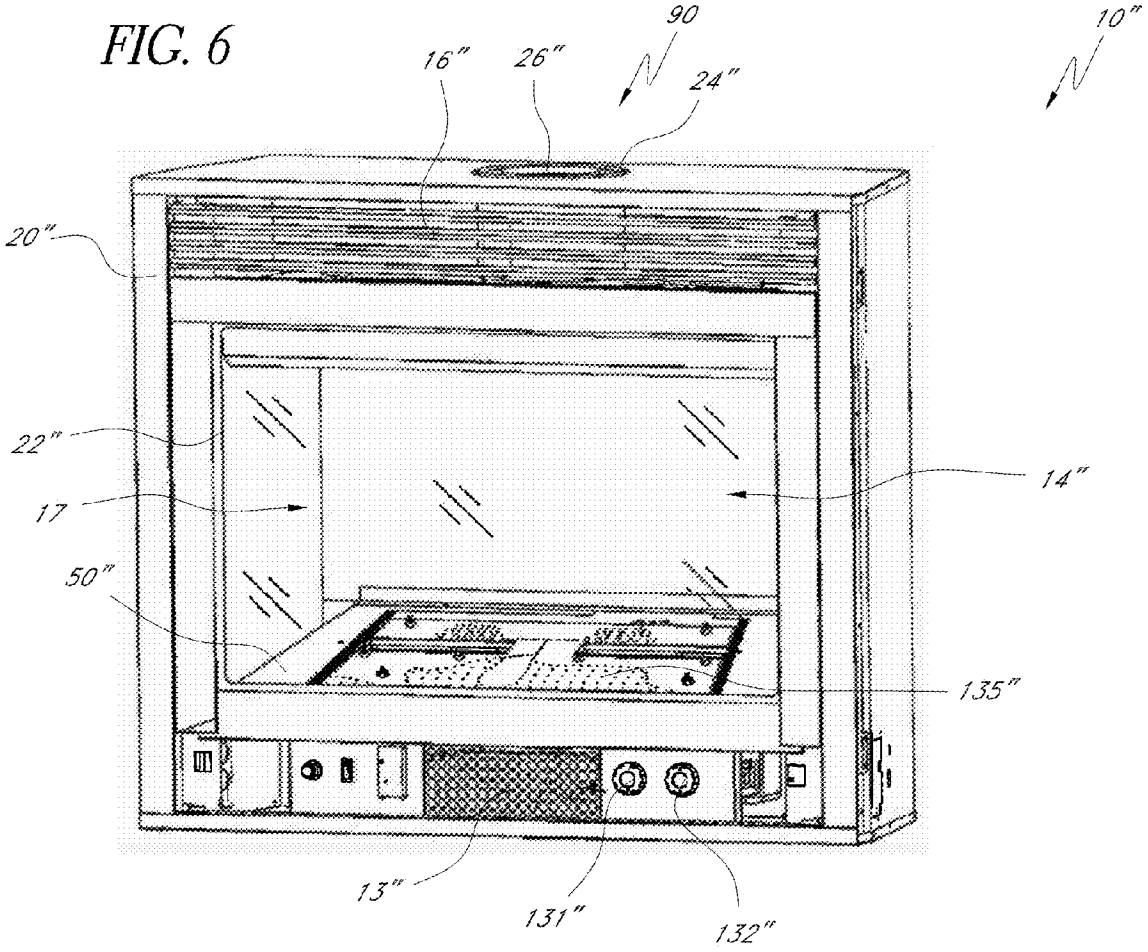
FIG. 6 is a perspective view of another embodiment of a heating device.
Figure 7:
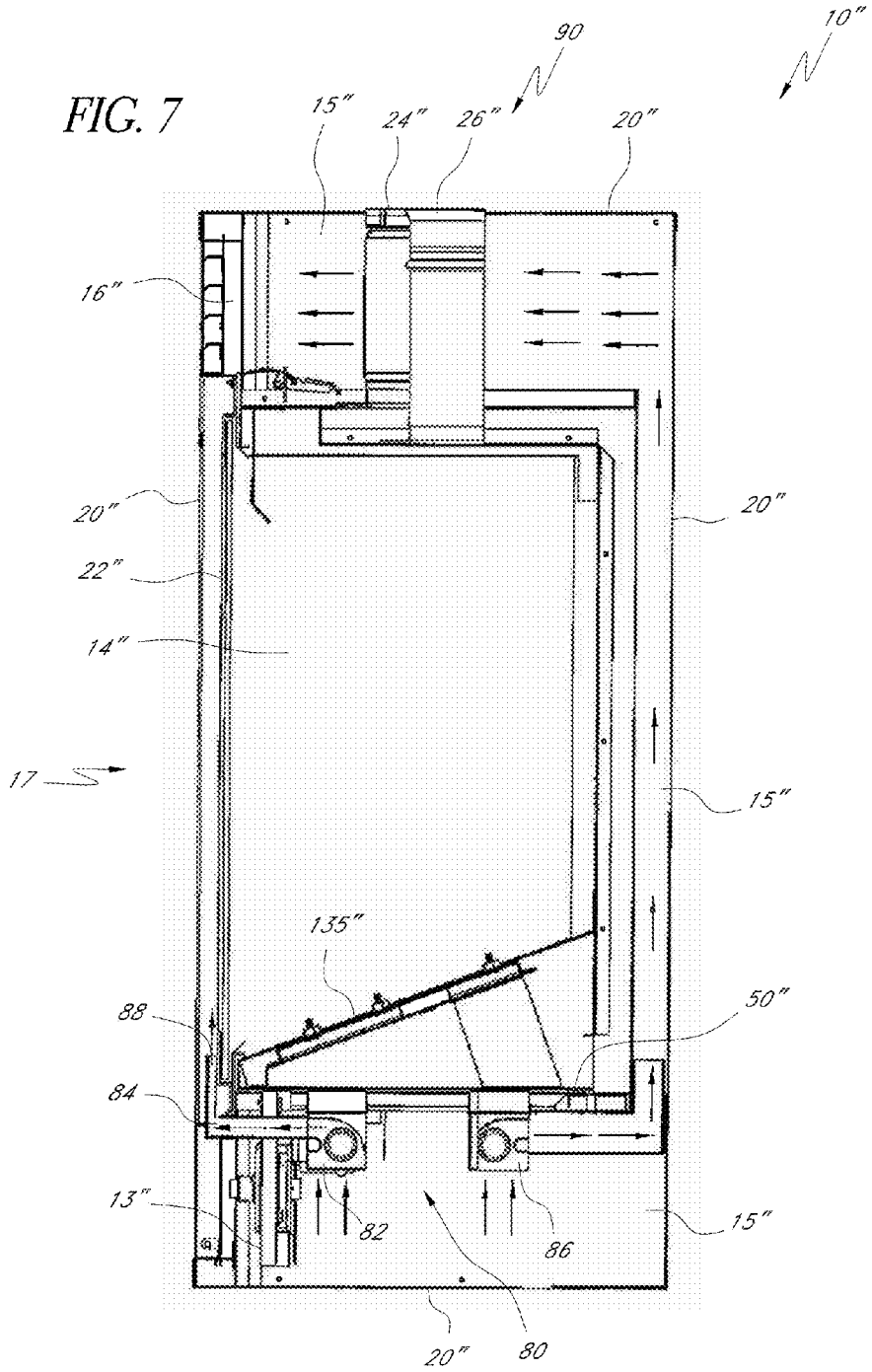
FIG. 7 is a partially disassembled cross-section side view of the heating device of FIG. 6.

In the illustrated embodiments of FIGS. 6 and 7, another embodiment of a direct vent gas fireplace assembly, or heating device 10", is shown. Numerical reference to components is the same as previously described, except that a double prime symbol (") has been added to the reference. Where such references occur, it is to be understood that the components are the same or substantially similar to previously-described components.

FIG. 6 shows a perspective view of the heating device 10" in an assembled view, with the exception of the front grill of the inlet vent 13" having been removed for clarity. The control system and fuel delivery system details are not shown; however, the control system and fuel delivery system can be any of the embodiments or a combination thereof, as described in detail above. FIG. 7 shows the heating device 10" in a partially disassembled view. For example, part of the control system and fuel delivery system has been removed for clarity.

The heating device 10" can include a housing 20" that encloses a sealed combustion chamber 14" with a burner 135" inside the sealed combustion chamber. The sealed chamber 14" can be sealed to the outside with the exception of the air intake 24" and the exhaust 26". Heated air does not flow from the sealed chamber 14" to the surroundings; instead air, for example from in an interior room, can enter an inlet vent 13" into the housing 20". The heating device 10" can further include an air circulation system 80 having one or more of a heating channel 15", inlet vent 13", climate control outlet vent or exhaust 16", cooling fan 82, cooling channel 84, and climate control fan 86.

As shown, the air circulation system 80 can be configured to deliver heated air to the interior room, or interior space, where the heating device 10" is installed, and to deliver cooling air to a front face 17 of the heating device 10".

The heating channel, conduit, or passage 15" can be disposed about, and extend proximate, the external surface of the sealed combustion chamber 14". The channel 15" can include a spaced gap between the sealed combustion chamber 14" and the fireplace housing 20". The channel 15" can be located on one or more sides of the fireplace assembly. For example, as shown, the channel 15" can be located on the bottom side, the back side, and the top side of the fireplace assembly. In some embodiments, the channel 15" can be located on the right side and/or left side of the fireplace assembly. The fluid channel 15" can be sufficiently proximate to the combustion chamber to heat the fluid, or room air, which is delivered through the channel 15". In some embodiments, the channels can share a wall with the housing defining the combustion chamber 14".

With continued reference to FIGS. 6 and 7, the channel 15" can be configured to receive interior room air, or climate control air, from the climate control air inlet vent 13", deliver the climate control air about a proximity of the sealed combustion chamber 14", and expel heated climate control air out of the climate control outlet vent 16". Heat emitted by the combustion of fuel and combustion air can be transferred to the climate control air delivered through channel 15" and generate the heated air.

The term "climate control" as used herein, is a broad term used in its ordinary sense, and includes features directed to the distribution of warmed fluid, such as, for example, interior room air, outside ambient air, or the like, and any combination thereof, to influence or control the room temperature where the fireplace is installed. For example, climate control air is distinguished from combustion air; however, in some embodiments, climate control air can provide the source of combustion air to the chamber 14", and/or the combustion air source can provide at least a portion of the climate control air.

The climate control fan 86 is configured to deliver, or blow, air through the channel 15". The climate control fan 86 can be located adjacent the channel 15", or generally positioned anywhere in fluid communication to the channel 15" flow path. The climate control fan 86 can have a variety of typical fan features, e.g. directed flow vents, variable speed controls, or the like. The climate control fan 86 can be a transflow, or centrifugal, configuration fan. In some embodiments, the climate control fan 86 can be an array of one or more axial propeller fans. In some embodiments, the air flows through the channel 15" by natural convection, without the assistance of a fan.

The air circulation system 80 can include a second channel, or the cooling channel 84. The cooling channel 84 can be configured to deliver output air from the cooling fan 82 to front face 17, i.e. the exterior surface of the window 22". In the illustrated embodiment in FIG. 7, the cooling channel 84 extends under the floor 50" of the sealed combustion chamber in a forward direction toward the front face 17, and then extends upward on a lower portion of the front face 17.

The cooling channel 84 can include a cooling exhaust vent 88 located at the downstream end of the cooling channel. The cooling exhaust vent 88 can be positioned proximate or adjacent to, the window 22" and front face 17. The air can cool the exterior surface of the window 22" to a surface temperature that can be safe to the touch. The cooling channel 84 can deliver a portion of air received by the channel 15" through the inlet vent 13". In some embodiments, the cooling channel can be configured to receive air directly from any air source, e.g. the interior room, outside ambient air, or the like. In addition, the cooling channel 84 and cooling fan 82 can deliver air from a dedicated inlet vent.

As shown, the cooling exhaust vent 88 generally extends, or spans, substantially the full width of the fireplace assembly's front face 17. In some embodiments, the cooling exhaust vent 88 can span a portion of the front face, e.g. ¼, ½, ¾, substantially the entire width, or the like, across the front face 17. The vent 88 can be configured to direct air evenly across and over the window 22" exterior surface via a constant geometry exit area across the vent 88 width. In some embodiments, the cooling exhaust vent 88 can be configured to direct increased proportions of the cooling air flow mass to specific portions of the window. For example, increased cooling air flow can be directed to localized hot spots that have relatively higher surface temperatures, or to portions of the window 22 most likely to incur user contact, such as adjacent a control knob or a door or window handle.

In addition, though FIG. 7 shows the cooling exhaust vent 88 only on the bottom of the window, it is to be understood that the cooling exhaust vent 88 can be located at many different locations along the front face 17. For example, the cooling exhaust vent 88 can be located along one or more of the sides, the top, and/or the bottom of the front face 17. In addition, the cooling exhaust vent 88 can include one or more cooling fans 82 and can comprise one or more cooling channels 84 which may or may not be connected.

The cooling fan 82 is configured to blow air through the cooling channel 84. The cooling fan 82 can be located adjacent the cooling channel 84 and the channel 15", or generally positioned anywhere in fluid communication to the cooling channel 84 and the channel 15" flow path. As mentioned previously, the cooling channel 84 and cooling fan 82 can deliver air from a dedicated inlet vent which may or may not be connected to the channel 15". The cooling fan 82 can have a variety of typical fan features, e.g. directed flow vents, variable speed controls, or the like. The cooling fan 82 can be a transflow, or centrifugal, configuration fan. In some embodiments, the cooling fan 82 can be an array of one or more axial propeller fans.

The cooling fan 82 can generally span a sufficient width of the cooling channel 84 to provide a consistent and even flow of cooling air up a substantial portion of the window 22". In some embodiments, the cooling fan 82 can span ¼, ½, ¾, the entire width, or any other sufficient portion of the cooling channel 84 width, or the window 22" width, that is sufficient to deliver cooling air over the window 22". The cooling fan 82 can be sized to provide sufficient capacity, or air mass flow rate capability, to cool the exterior surface of the window 22" to safe temperatures. The cooling airflow exiting the vent 88 can generally flow up substantially the full height off the window 22". In some embodiments, the cooling air can flow over a portion of the window 22" height, e.g. ¼, ½, ¾, substantially the entire height, or the like, up the window 22". The cooling fan 82 can be positioned under the sealed combustion chamber 14" and generally upstream of the climate control fan 86; thus, the cooling fan can be located between the inlet vent 13" and the climate control fan 86. In some embodiments, the climate control fan 86 can be located upstream of the cooling fan 82.

The cooling fan 82 can generally be positioned in a first half of the channel 15" extending from the air inlet vent 13". As described above, the channel 15" can define a flow path from the front face 17 under the floor 50", up the back side of the chamber 14", and over the top side of the chamber 14" to the outlet vent 16". In some embodiments, the cooling fan 82 can be positioned in a first ¼, ⅓, ⅔, or any portion thereof, of the channel 15" flow path. Similarly, the cooling fan 82 can be positioned in any portion of the channel 15" such that the air drawn into and blown out of the fan 82 is not substantially heated by the combustion in the sealed combustion chamber 14". In some embodiments, heated air can be drawn into the cooling fan 82 and directed to the window 22". In some embodiments, the cooling fan 82 can be located outside of the channel 15".

The cooling fan 82 can include a control module, which is not shown, that is coupled to, and can control, the operation of the fan 82 and the burner 135". The control module can cool the window 22" by activating the fan 82 when the burner 135" is in operation, or activated. The control module can further deactivate, or turn off, the burner 135" when the control module receives input, or a lack thereof, that the cooling fan 82 is not functioning properly. In this manner, the burner 135" turns off and prevents the window 22" from becoming excessively hot.

In some embodiments, the control module controls the cooling fan 82 to remain on and blowing cooling air to the window 22" after the burner 135" is deactivated. In some embodiments, the cooling fan 82 is controlled to remain on for a predetermined amount of time after the burner 135" is turned off. The cooling fan can remain on for two, five, ten, or any number of minutes to maintain a cool window temperature. The extended cooling fan operation prevents excessive window temperatures that can result from the transfer of residual heat in the walls, or structure, of the sealed combustion chamber, or firebox. The predetermined time can be factory set, or can be adjusted by the user during or after installation. In some embodiments, the predetermined time can be adjusted via a control module interface, which is not shown.

In some embodiments, the fireplace assembly can include a thermocouple proximate the window 22", or more preferably an exterior surface of window 22". The thermocouple can provide a feedback control system with the control module that can keep the cooling fan 82 activated until the window achieves a predetermined safe temperature. The predetermined temperature can be factory set or selected by the user after installation.

The direct vent heating device 10" can provide efficient heating and does not require a chimney for safe operation. The direct vent heating device 10" can direct outside ambient air through a combustion vent system 90 for heat generating combustion, and thus does not deprive interior living spaces of oxygen or heated air.

The heating device 10" can include a combustion vent system 90, or flue, that can extend outward from the heating device 10" and be directed horizontally through an external wall or vertically to a roof. As shown, the vent system 90 includes two collinear ducts, the inner and outer flue, or the combustion air intake duct 24" and the combustion air exhaust duct 26". The illustrated air exhaust 26" is smaller in diameter than air intake 24", and air exhaust 26" extends within the larger air intake 24" and generally shares a common longitudinal axis. The internal air exhaust 26" generally directs combustion exhaust gas out of the fireplace. The external air intake 24" generally draws external, or outside, air into the fireplace through the annular space between the smaller diameter combustion exhaust 26" and the larger diameter air intake 24". External air is generally the ambient air outside of the building structure being heated. In some embodiments, the air intake 24" can be the smaller diameter and extend within the larger diameter air exhaust 26". The collinear vent system can improve the system efficiency of heating device 10" because the air entering in the annular space is warmed by passing over and about the heated combustion exhaust 26" prior to combustion at the burner 135".

Dual Direct Vent and Vent Free Fireplace

The embodiments described in FIGS. 1-7 disclose a gas fireplace assembly with several control system embodiments to control the performance parameters of the gas fireplace and a cooling structure for a face of the fireplace. Although the description of the embodiments of FIGS. 8-11 provided below does not include specific details of a control system, it is understood that the following duel direct vent and vent-free fireplace embodiments can include any of the above described control systems, in whole or in part, and any combination of the various components or features of the control systems described above.

In the illustrated embodiments of FIGS. 8-11, another embodiment of a heating device 10''', a dual-function direct vent and vent free gas fireplace assembly, is shown. The heating device 10''' is able to function in either a direct vent configuration or a vent free configuration. A direct vent fireplace, as described above, can be vented out through the wall or through the roof to the exterior of a structure, building, or home. A vent free gas fireplace does not require an external vent or a chimney, rather the exhaust is vented directly into the interior of a structure, building, or home. The heating device 10''' can include many similar characteristics and/or features as the heating device 10" of FIGS. 6 and 7. Numerical reference to components is the same as previously described, except that a triple prime symbol (''') has been added to the reference. Where such references occur, it is to be understood that the components are the same or substantially similar to previously-described components.

Figure 8:
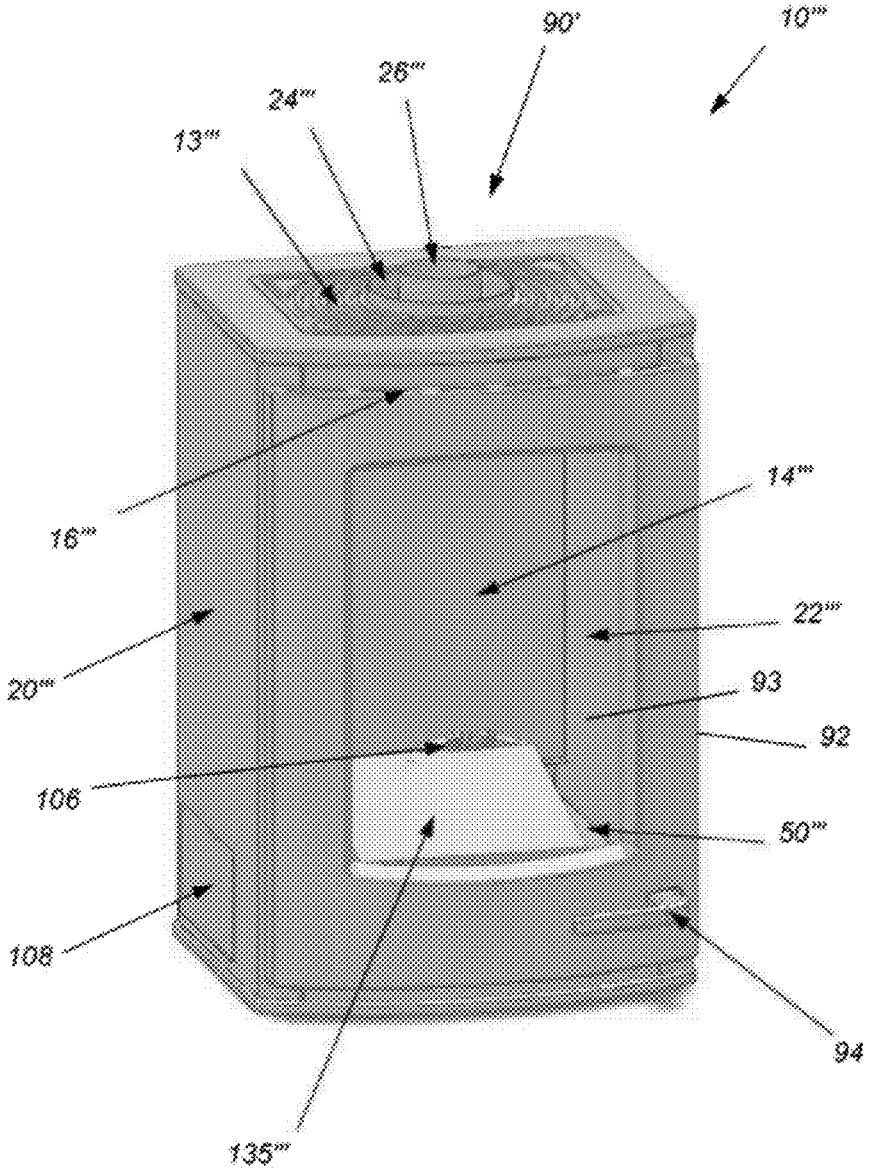
FIG. 8 is a perspective view of another embodiment of a heating device.
Figure 9:
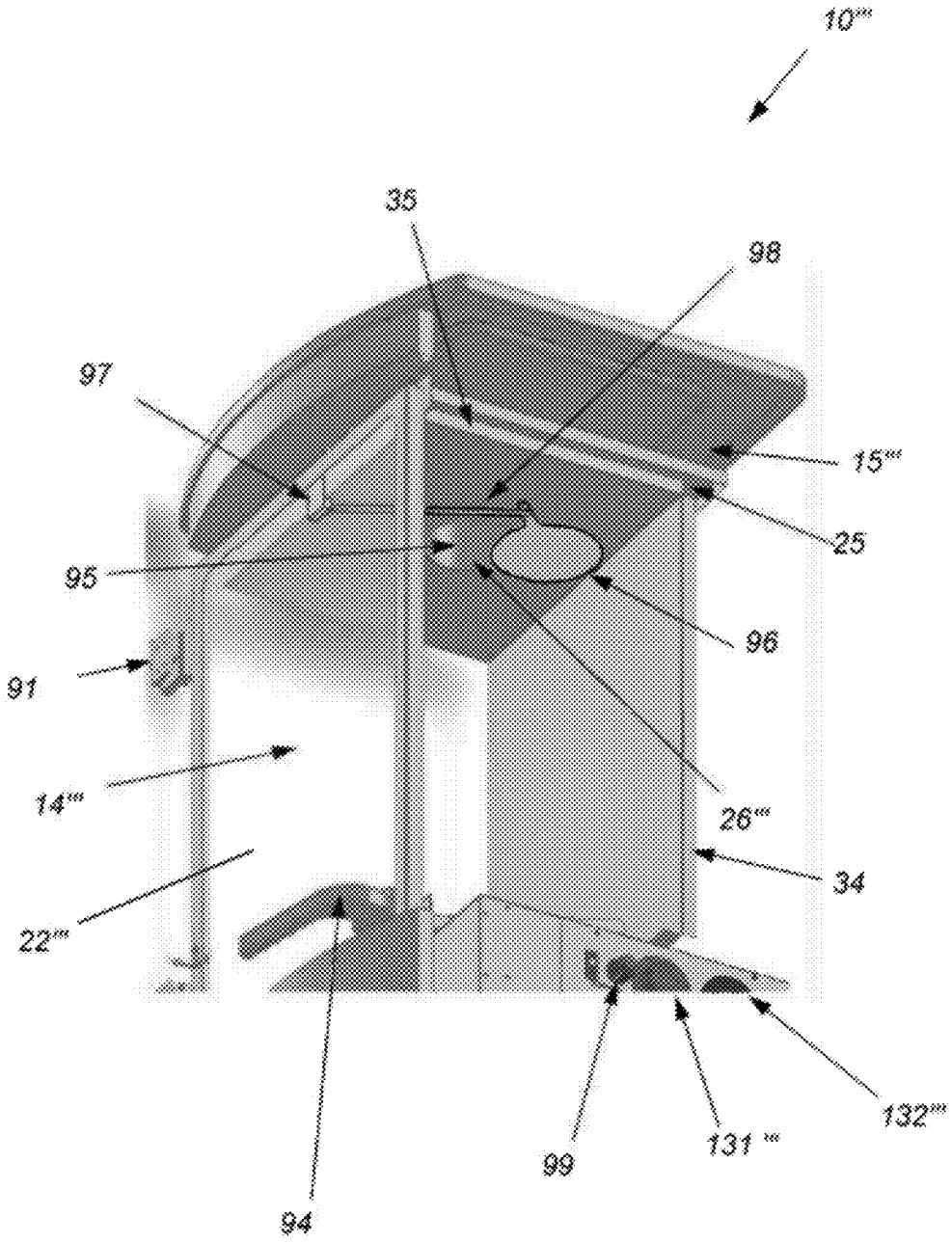
FIG. 9 is a partially disassembled cross-section perspective view of the heating device of FIG. 8.

With reference to FIG. 8, the dual-function direct vent and vent free gas fireplace 10''' is shown in an assembled view. The control system and fuel delivery system details are not shown; however, the control system and fuel delivery system can be any of the embodiments or a combination thereof, as described in detail above or as further described below. FIG. 9 shows the heating device 10''' in a partially disassembled cross-section view. For example, parts of the control system and the fuel delivery system have been removed for clarity.

With reference to FIGS. 8 and 9, the heating device 10''' desirably can function as both a direct vent fireplace system or as a vent free fireplace system. The dual system fireplace desirably can provide suitable heat in a variety of scenarios, improving the operability of the fireplace in general, e.g. operable both with and without a source of electricity. The fireplace 10''' can advantageously include at least two features that can accommodate the interchangeable direct vent and vent free configurations within the single fireplace. These features can include a closing mechanism for a combustion chamber exhaust outlet 95 and a removably installed sealed door 92 and/or window 22'''.

The fireplace 10''' can include an exhaust pipe 26''' that can maintain fluid communication between the sealed combustion chamber 14''' and the ambient environment for expelling the combustion exhaust from the burner 135''' disposed in the sealed combustion chamber. As has been explained herein, the exhaust pipe 26''' is used in the direct vent configuration. The combustion chamber outlet 95 at the exhaust pipe 26''' can include an exhaust cover, or baffle 96, that can be positioned over the combustion chamber exhaust outlet 95 to seal the combustion chamber 14''' from the ambient environment. This can allow the heating device 10''' to be used in the vent free configuration.

The exhaust cover 96 can fit over the exhaust outlet 95 and prevent heated air from exiting the chamber 14''' and colder external ambient air from entering the chamber. The cover 96 can have a sealing member, or gasket, non-metallic interface, or the like, to facilitate the sealing feature of the cover. The sealing member can be capable of exposure to the high temperatures of the chamber 14'''.

It should be noted that the exhaust cover 96 as shown, does not cover the air intake 24'''. In some embodiments, the fireplace 10''' can continue to draw, via a pressure differential between the air intake and the combustion at the burner, or the like, external ambient air to combust at the burner 135'''. In some embodiments, the air intake 24''' can similarly be closed when using the heating device 10''' in the vent free configuration. As will be described in more detail below, for vent free operation the window 22''' can be opened or removed to allow for proper exhaust and/or air inflow. As will be understood, opening or removing the door 92 and/or window 22''' unseals the previously sealed combustion chamber 14''' and allows for the exchange of air and exhaust between the combustion chamber and its surroundings.

With particular reference to FIG. 9, the cover 96 can be pivotably coupled to a controller, or arm member 98, that desirably can selectively open or close the exhaust outlet 95. The controller 98 can position the cover 96 over the exhaust pipe 26''' to completely close the exhaust, or can position the cover adjacent the exhaust 26''' to completely open the exhaust. In addition, the controller 98 can position the cover 96 anywhere between these two positions. Alternatively the cover could have a number or fixed positions or only partially cover and/or uncover the exhaust pipe 26'''. The controller 98 can be any form of motion inducing device, e.g. mechanically via a cam, an arm, or the like, or electronically, pneumatically, magnetically, or the like.

The controller 98 can be coupled to the cover 96 and removably coupled, e.g. magnetically, spring-loaded, interference fit, or the like, to the window 22''' at a window coupling 97. The controller 98 can release from the window coupling 97 when the window is opened or removed from a face of the fireplace. The cover 96 and/or controller 98 can be biased such that the cover 96 moves to the closed position when the controller 98 is released from the window coupling 97. The cover 96 and/or controller 98 can be biased by a spring, or the like, to pivotably or laterally move into position over the exhaust outlet 95. Thus, the exhaust outlet 95 can be automatically closed, or substantially sealed, upon opening or removal of the window 22'''. This can facilitate moving the heating device to the vent free fireplace configuration.

In some embodiments, the cover 96 can be positioned by other automated, or automatic, means upon opening or removal of the window and/or door, which are known to those of ordinary skill in the art. In some embodiments, the controller 98 can be a spring loaded member in a compressed configuration with the window installed, thereby urging the cover 96 away from the exhaust; however, removal of the window uncompresses the spring and urges the cover 96 toward the exhaust 26'''. In some embodiments, the controller 98 can be one or more arm members coupled to an interior surface of the combustion chamber, e.g. top, front, back, right side, left side, or the bottom of the combustion chamber. In some embodiments, the controller 98 can be a solenoid powered to prevent spring-biased movement of the cover 96 over the exhaust 26''', and upon loss of electricity the solenoid allows the spring-biased cover 96 to seal off the exhaust pipe 26''' from the chamber.

The fireplace 10''' can be modified from the direct vent configuration to the vent free configuration manually or automatically. In some embodiments, the exhaust cover can be moved to the closed position to close and seal the chamber exhaust, via any of the various means described above as well as similar or equivalent means not described. In the event of a loss of electricity, proper functioning of the fireplace electronic components may be prevented. For example, electronically controlled fuel valves, regulators, and/or circulation fans may not work. To maintain continued heat generation to a building interior, the direct vent fireplace 10''' can be readily and safely converted to a vent free fireplace 10''' by closing the cover 96 and opening the sealed face of the chamber 14'''.

The fireplace 10''' can include a door 92 disposed on the front face of the fireplace, coupled, in one embodiment, by at least one hinge 91. The door 92 can include a frame disposed about a window 22'''. The frame can be any suitable material, e.g. metallic, or the like. The window 22''' can provide a clear visual of the flame, logs, or the like, disposed within the chamber and configured to provide a natural flame appearance. The door 92 can lockingly seal and engage the chamber 14'''. The door can include a handle 94 that can control a locking, or latching mechanism, and provide a feature to securely and safely hold onto, or grab, the door 92 to open, close, or generally control the door.

The window 22''' and/or door 92 can establish a sealed side face of the sealed combustion chamber 14''' when the fireplace 10''' is configured to operate as a direct vent heating device. In particular, the window 22''' can establish the front side face of the fireplace. In some embodiments, the side of the fireplace 10''' can be any face, or surface, of the fireplace that extends from the bottom to the top of the fireplace, or an intermediate portion thereof. In some embodiments, the window 22''' can be removable to provide an open front face of the fireplace 10''' and provide the heat transfer from the fireplace through the open face to the building interior, rather than, or in combination with, fan-driven forced ventilation. In some embodiments, the window 22''' can be positioned on any face of the fireplace 10''', e.g. front, back, right, left, top, or bottom.

The window 22''' can be a variety of different configurations, e.g. single piece, multi-piece, framed, with or without handles, or the like. The window 22''' can be fabricated and have material characteristics similar to the windows 22, 22', 22'' described above. In some embodiments, only a portion of the window 22''' can be removed from sealed engagement with the fireplace front side face, or any face thereof. In some embodiments, the entire window 22''' or a portion of the window 22'' can be completely removed from the face of the heating device, such that the window is either installed on the fireplace or not installed on the fireplace. In some embodiments, the window 22''' can be removed from the door 92. In some embodiments, the window, or portion thereof, is hingedly, such as by hinges 91, or the like, coupled to the fireplace 10''', and can be rotated or pivoted about the coupling to disengage the sealed interface between the window and the fireplace 10''' front face 17'. The window can be pivotably controlled by a rotatable handle, much like a typical casement window device. The window can be slidably movable to open all or a portion of the fireplace face. In some embodiments, a multi-piece window can be rotated and folded away from the front face of the fireplace.

Though a window 22''' is described above, it should be understood that a window is not required and that the window can be replaced with other structures, including heat radiating structures. Also, any part of the heating device 10''' can be opened or removed to move the heating device 10''' to the vent free configuration, so long as by so doing the combustion chamber is no longer sealed allowing the free exchange of air and exhaust between the combustion chamber and the interior room environment, or the environment where the heating device is located. For example, the heating device 10''' can be a cast iron stove/fireplace or have the appearance of a cast iron stove/fireplace. In such an embodiment, it is unlikely that there will be a window, but a door may be located at the front face, or on another surface that can serve the same or similar purposes as the window described herein.

In some embodiments, opening the window or door can expose an inlet vent that was previously blocked to allow air to enter through the newly exposed and opened inlet.

In some embodiments, the fuel delivery system can include electronic controllers and/or electronic mechanisms, e.g. electronic regulator, valves, air shutter, or the like (not shown). The fuel delivery system components can be similar to the fuel delivery system 40 described above, or the systems and devices disclosed in the incorporated U.S. Pat. No. 7,434,447. Upon loss of electricity, the electronic regulator, and/or fuel valve, can be configured to automatically shut down, or deactivate, to prevent accumulation of uncombusted fuel within the combustion chamber 14''' should the flame at the burner 135''' extinguish. In some embodiments, the electric valve assembly controlling direct vent combustion can become inoperable when electric power is lost to the fireplace 10'''. In some embodiments, a loss of electricity to the fireplace 10''' can render the unit useless as a heat source.

In some embodiments, the fuel delivery system can advantageously include a both a manual and an automatic control valve, where the control valve is used to control the amount of fuel flowing to the burner. The manual valve can be configured to provide less fuel to the burner and thereby provide a lower energy output as compared to the automatic control valve. The manual valve can be operated manually by a control knob on the fireplace 10'''. The reduced energy, e.g. decreased BTU/hr output of the flame, or the like, can eliminate or reduce the volume of combustion air emissions emitted into the building interior and maintain safe air quality conditions, even with the combustion chamber exhaust outlet 95 covered, or closed, by the exhaust cover 96. In some embodiments, the burner and/or flame characteristics can be controlled by the first knob 131''' and/or the second knob 132'''.

In some embodiments, the coupling 97 can be part of a circuit, such that opening the window also opens the circuit. The circuit can be connected to the electronic powered automatic control valve which powers down when the circuit is opened. Fuel flow can then be directed to the manual valve operating at a lower BTU/hr rating. Alternatively, a button switch may be depressed or released when the window is opened or removed, thereby deactivating the automatic control valve.

In some embodiments, the fuel delivery system can advantageously include a second valve and/or other fuel system components (not shown), that can be manually opened, controlled, and ignited. The second valve can, either alone, or in combination with a second burner (not shown), provide a lower energy output. In some embodiments, the valve can be operated manually by a control knob 99 disposed on an outer surface of the fireplace 10'''. The reduced energy, e.g. decreased BTU/hr output of the flame, or the like, can eliminate or reduce the volume of combustion air emissions emitted into the building interior and maintain safe air quality conditions, even with the combustion chamber exhaust outlet 95 covered, or closed, by the exhaust cover 96. In some embodiments, the burner and/or flame characteristics can be controlled by the first knob 131''' and/or the second knob 132'''.

With reference to FIG. 8, the dual-function direct vent and vent free fireplace 10''' can further include one or more oxygen depletion sensors (ODS) 106. The ODS can include the various features and characteristics disclosed in U.S. Pat. No. 7,434,447, and incorporated by reference as described above. The ODS can include a pilot and a thermocouple arranged such that the flame from the pilot heats the thermocouple and the heat indicates oxygen levels, for example reduced oxygen levels can result in an extinguished pilot flame and decreased thermocouple temperatures. The oxygen depletion sensor can indicate when oxygen levels reach dangerous low levels. In some embodiments, the ODS can always be operational, for example, when the fireplace 10''' is operating in the direct vent mode and external ambient air provides the combustion air to the burner. In some embodiments, the ODS can become operational upon opening or removal of the window 22''' and the closure of the exhaust 26'''. The ODS can be particularly suitable for operation in embodiments whereby the external ambient air intake is closed in the vent free configuration.

In some embodiments, the fireplace 10''' can include multi-fuel capability, allowing the fireplace to operate on one fuel among a group of multiple types of fuel, e.g. natural gas, propane, or the like. Such a dual fuel configuration, described above, and further described in incorporated U.S. Pat. No. 7,434,447, can provide a regulator configured to function within distinct pressure ranges, ranges that are typical of the proposed gases, or fuels, for the fireplace operation.

Figure 10:
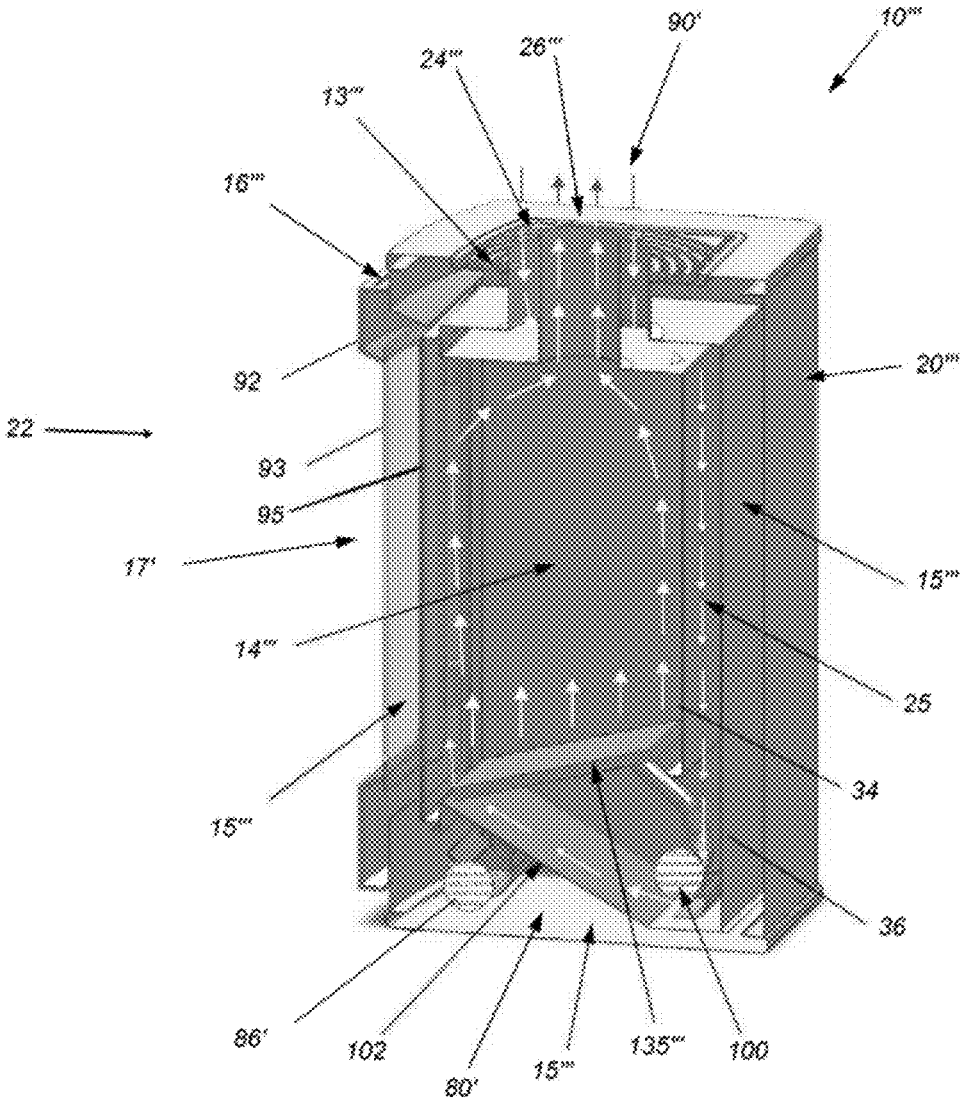
FIG. 10 is a partially disassembled cross-section perspective view of the heating device of FIG. 8.
Figure 11:
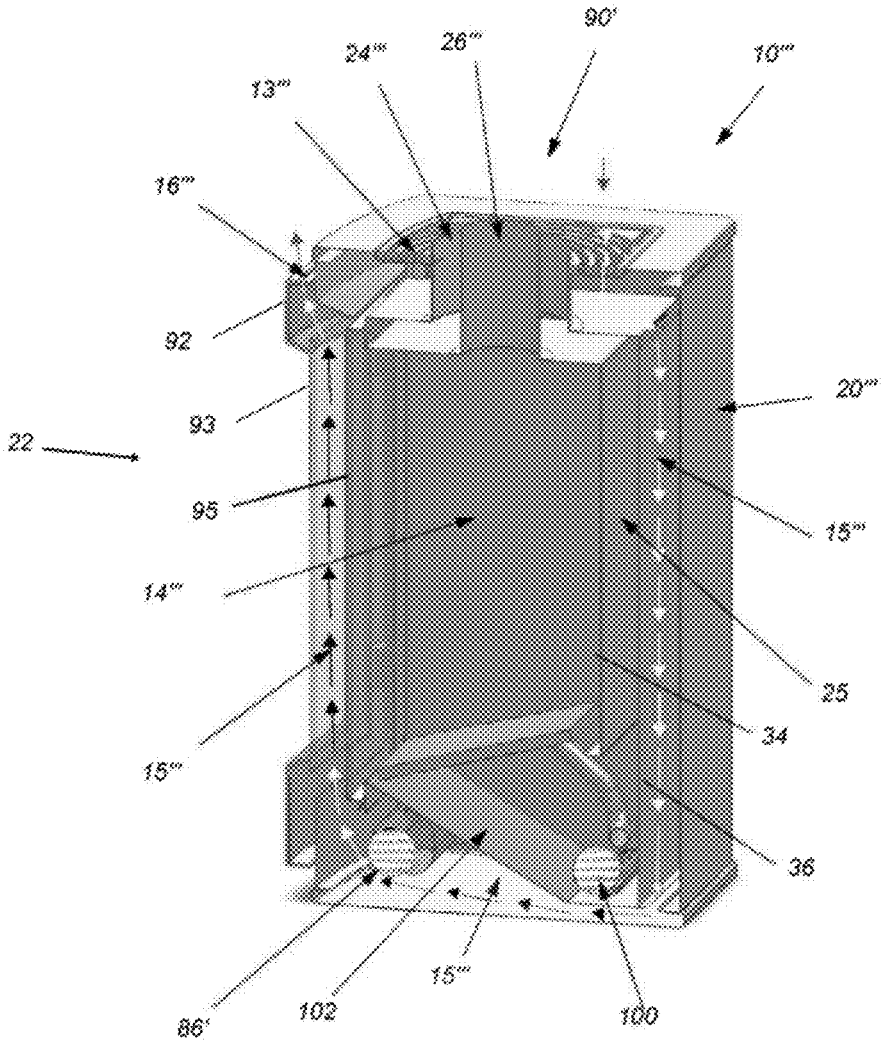
FIG. 11 is partially disassembled cross-section perspective view of the heating device of FIG. 8.

Turning now to FIGS. 10 and 11, the flow circulation path within the fireplace 10''' is shown for an embodiment of a direct vent configuration. The fireplace 10''' is shown with two circulation fans, a first fan 100 for a combustion vent system 90' and a second fan 86' for a heating air circulation system 80'. Together the two flow systems 80' and 90' can provide complete, or substantially complete, combustion and consistent heat transfer to the room interior where the fireplace 10''' is installed and functioning in a direct vent configuration.

The circulation flow path of the combustion vent system 90' is shown by the arrows depicted in FIG. 10. The combustion vent system 90' can include a combustion air intake 24''', an exhaust 26''', a combustion air channel 25, a baffle 102, and a combustion fan 100. The combustion system 90' can be configured similar to the systems and embodiments described above, bringing external ambient air from the air intake 24''', into the combustion chamber 14''' and then expelling the exhaust air out the exhaust 26''' to the external ambient environment. Thus, the interior air generally does not take part in the combustion process and can generally avoid being either the combustion air or mingling with the exhaust emission from the fireplace.

The combustion air intake and exhaust are desirably collinear as described above with respect to heating device 10''. The combustion air channel 25 can be a spaced gap between two panels of the chamber 14''', such as between an interior panel 34 and an exterior panel 36 that establish the outside boundary, or surfaces, of the sealed combustion chamber 14'''. The channel 25 desirably extends along a top portion of the chamber 14''', then down a rear portion of the chamber to the base of a floor. The channel 25 desirably exits to the burner 135''' at the bottom of the combustion chamber 14''', where the combustion air drawn into the chamber via the combustion fan 100 desirably is directed to the burner and to the window 22'''. The interior panel, or conduit panel 36, desirably can be parallel to the rear firebox panel 34 within the sealed combustion chamber 14'''.

The combustion fan desirably can be disposed within the combustion chamber 14''' to direct the incoming ambient combustion air toward the burner 135''' and the window 22'''. In some embodiments, the baffle 102 can be disposed adjacent the floor and can direct the combustion air toward the window 22''' and/or the burner 135'''. The use of combustion fan 100 to force combustion air toward the burner can increase, or improve, the mixing of fuel and combustion air thereby improving combustion characteristics at the burner flame. For example, improved combustion can result in cleaner combustion of the fuel and reduced air pollutants in the combustion emissions of the fireplace 10'''.

The combustion fan 100 can generally be positioned in any suitable arrangement within the chamber 14'''. In some embodiments, the combustion fan 100 can be positioned in a first ¼, ⅓, ⅔, the final ¼, ⅓, or any portion thereof, of the heating channel 25 flow path, or accordingly, of the floor portion of the heating channel 15'''. Similarly, the combustion fan 100 can be positioned in any portion of the channel 15''', e.g. a first ¼, ⅓, ⅔, the final ¼, ⅓, or any portion thereof, such that the air drawn into and blown out of the fan 100 is not substantially over-heated by the combustion in the sealed combustion chamber 14'''. In some embodiments, the combustion fan 100 can be located outside of the channel 15'''.

In some embodiments, ambient air can be drawn into the combustion fan 100 and directed to the window 22'''. As shown, the baffle 102 is angled with respect to the window 22 such that air directed at the baffle 102 will flow upwards towards the burner 135''' or towards the window 22'''. As can also be seen, a small gap is formed between the burner 135''' and the baffle 102. This small gap can direct air flow to the window 22'''. This air flow directed at the window can include ambient air at a lower temperature than the exhaust air. As will be understood, the lower portion of the window may be in close contact with the flames and heat from combustion at the burner 135'''. Directing a flow of air at the lower portion of the window can help cool the window 22'''.

The combustion airflow pushed by the combustion fan 100 can generally flow up substantially the full height off the window 22''' on the chamber inside surface. In some embodiments, the combustion air can flow over a portion of the window 22''' height, e.g. ¼, ½, ¾, substantially the entire height, or the like, up the window 22'''. The combustion fan 100 can be positioned within the sealed combustion chamber 14'' and generally upstream of the baffle 102; thus, the combustion fan 100 can be located between the air intake 24''' and the window 22'''.

The circulation flow path of the fluid circulation system 90' is shown by the arrows depicted in FIG. 11. The fluid circulation system 90' can include a vent inlet 13''', a heating channel 15''', a climate control outlet vent or exhaust 16''', and climate control fan 86'. The fluid circulation system 80' brings interior air into a flow path disposed about the combustion chamber 14'''. Though the vent inlet 13''' is shown on the top of the fireplace 10''', the vent inlet can function in a similar manner as those discussed previously, including vent inlet 13 shown in FIG. 1 to draw into the fireplace 10''' to be heated within the fireplace.

Advantageously, the interior air can cool the rear firebox panel 34 surfaces of the fireplace 10''' chamber, and cool the glass window 22''' while at the same time absorbing heat energy and heating the air flow within the channel 15''', and then dispersing the heated air out of the fireplace to heat the room interior.

As can be seen, the window 22''' can be a dual paned window having a first pane 93 and a second pane 95. The second pane 95 can form part of the sealed chamber and can be closest to the burner 135'''. The channel 15''' can run between the two panes of window 22''', cooling the window and decreasing the burn risk and fire risk. Even when the fan 86' is not on or running, the dual paned window creates an added barrier between the glass closest to the flames and the room interior. This barrier can also be effective to reduce the burn and fire risks.

The heating channel 15''' can extend from the air vent inlet 13''' disposed about the flue, or the combustion air intake 24''' at a top portion of the heating device 10''', rearward between the top portion of the fireplace and the top portion of the chamber 14'''. The channel 15''' then progresses downward and behind the rear firebox panel 34 of the chamber 14''' to the volume underneath the floor. The channel 15''' then proceeds from under the floor through the space gap between the two panes 93, 95 of the dual paned window 22''' on the door 92. The heating channel 15''' can vary according to suitable geometry, and can take any form set forth above. The interior air exchanges heat from the chamber 14''' generally continuously as the air travels through the at least three portions (rear, bottom, front) of the channel 15'''. In particular, the heating air forced through by the climate control fan 86' can cool the front face window 22''' to prevent the surface from becoming excessively hot during use of the fireplace 10'''.

The climate control fan 86' can be disposed in the heating channel 15'''. The fan 86' draws interior air into the fireplace through the air vent inlet 13'''. The fan 86' can have the various characteristics described above with respect to cooling fan 82 and/or climate control fan 86.

The climate control fan 86' can generally be positioned in a first half, or a first two-thirds, of the channel 15''' extending from the air inlet vent 13'''. As described above, the channel 15''' can define a flow path from the top surface of the fireplace 10''', down the back side of the chamber 14''', and under the floor of the combustion chamber 14''' to the window 22''' between the first pane 93 and the second pane 95, then out the outlet vent 16'''.

In some embodiments, the climate control fan 86' can be positioned in a first ¼, ⅓, ⅔, or any portion thereof, of the channel 15''' flow path. Similarly, the climate control fan 86' can be positioned in any portion of the channel 15''' such that the air drawn into and blown out of the fan 86' is not substantially over-heated by the combustion in the sealed combustion chamber 14'''. In some embodiments, heated air can be drawn into the climate control fan 86' and directed to the window 22'''. In some embodiments, the climate control fan 86' can be located outside of the channel 15'''.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

Similarly, this method of disclosure, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A gas fireplace assembly comprising:

a sealed combustion chamber having a door;

a first burner disposed within said combustion chamber;

an air inlet;

a first air conduit in fluid communication with said air inlet and in sufficient proximity to said sealed combustion chamber that air within said first air conduit can be warmed by said sealed combustion chamber;

a combustion air conduit in fluid communication with said sealed combustion chamber and configured to route combustion air to said sealed combustion chamber;

a combustion air exhaust having an opening in fluid communication with said sealed combustion chamber and configured to remove exhaust air from said sealed combustion chamber;

a cover configured to removably cover said opening of said combustion air exhaust, said cover operably connected to said door, such that opening said door causes the cover to move to a closed position covering said opening and closing said door causes said cover to move to an open position uncovering said opening;

wherein said cover and said door are configured to convert said gas fireplace assembly from a first configuration to a second configuration; and wherein said first configuration vents combustion exhaust exclusively through said combustion air exhaust to an exterior of a structure and said second configuration vents combustion exhaust exclusively to an interior of a structure.

2. The gas fireplace assembly of claim 1, further comprising a mechanical linkage connecting said door and said cover.

3. The gas fireplace assembly of claim 2, further comprising a spring, wherein said cover is biased to the closed position.

4. The gas fireplace assembly of claim 1, further comprising a sensor or button configured to detect the opening of said door.

5. The gas fireplace assembly of claim 1, further comprising a manual control valve to control a reduced energy output flame of said first burner when said gas fireplace is operable in said second configuration.

6. The gas fireplace assembly of claim 1, wherein said first burner has a maximum BTU output when in said first configuration and a second maximum BTU output when in said second configuration.

7. The gas fireplace assembly of claim 1, wherein said first configuration is a direct vent gas fireplace and said second configuration is a vent free gas fireplace.

8. The gas fireplace assembly of claim 1, further comprising an oxygen depletion sensor.

9. A gas fireplace assembly comprising:

a sealed combustion chamber having a door;

a first burner disposed within said combustion chamber;

an air inlet;

a first air conduit in fluid communication with said air inlet and in sufficient proximity to said sealed combustion chamber that air within said first air conduit can be warmed by said sealed combustion chamber;

a combustion air conduit in fluid communication with said sealed combustion chamber and configured to route combustion air to said sealed combustion chamber;

a combustion air exhaust having an opening in fluid communication with said sealed combustion chamber and configured to remove exhaust air from said sealed combustion chamber;

a cover configured to removably cover said opening of said combustion air exhaust, said cover operably connected to said door, such that opening said door causes the cover to move to a closed position covering said opening and closing said door causes said cover to move to an open position uncovering said opening;

a sensor or button configured to detect the opening of said door.

an automatic control valve; and a manual control valve, wherein said cover and said door are configured to convert said gas fireplace assembly from a first configuration to a second configuration, wherein said first configuration vents combustion exhaust to an exterior of a structure and said second configuration vents combustion exhaust to an interior of a structure;

wherein said sensor or button is configured to close said automatic control valve when the opening of the door is detected and direct fuel to the manual control valve.

10. The gas fireplace assembly of claim 9, further comprising a mechanical linkage connecting said door and said cover.

11. The gas fireplace assembly of claim 10, further comprising a spring, wherein said cover is biased to the closed position.

12. The gas fireplace assembly of claim 9, wherein said first burner has a maximum BTU output when in said first configuration and a second maximum BTU output when in said second configuration.

13. The gas fireplace assembly of claim 9, wherein said first configuration is a direct vent gas fireplace and said second configuration is a vent free gas fireplace.

14. The gas fireplace assembly of claim 9, further comprising an oxygen depletion sensor.

15. The gas fireplace assembly of claim 9, wherein the manual control valve is configured to provide less fuel to the first burner and thereby provide a lower energy output as compared to the automatic control valve.

16. The gas fireplace assembly of claim 9, wherein the sensor or button is part of a circuit, such that opening the door also opens the circuit, the circuit being connected to the automatic control valve which powers down when the circuit is opened.

* * * * *